United States Patent [19]

Webster

[11] Patent Number: 4,777,810

[45] Date of Patent: Oct. 18, 1988

[54] LATCHING ASSEMBLY WITH PANIC RELEASE

[76] Inventor: Desmond E. C. Webster, 346 - 7th Ave. SW. Box 430, Ephrata, Wash. 98823

[21] Appl. No.: 67,232

[22] Filed: Jun. 24, 1987

[51] Int. Cl.[4] ..... E05B 55/00

[52] U.S. Cl. ..... 70/150; 292/170; 292/174; 70/481

[58] Field of Search ..... 70/129, 134, 150, 481, 70/482; 292/170, 174

[56] References Cited

U.S. PATENT DOCUMENTS

| | | | |
|---|---|---|---|
| 2,960,858 | 11/1960 | Webster | 292/170 |
| 3,121,319 | 2/1964 | Webster | 292/170 |
| 3,582,121 | 6/1971 | Rollins | 292/170 |
| 3,955,838 | 5/1976 | Dee | 292/179 |

*Primary Examiner*—Robert L. Wolfe

*Attorney, Agent, or Firm*—Hughes, Cassidy & Multer

[57] ABSTRACT

A latching assembly having a retractable latch bolt and a slide bar which retracts the latch bolt by moving either forwardly or rearwardly from an intermediate position. The latching assembly has a rotatably mounted locking rod that rotates 90° between a locking and an unlocking position. The assembly is arranged with a "panic release" system, in that with the locking rod in its locked position, it is possible to push an "inside" button or cylinder forwardly so as to move the locking rod to at least a partially released position to permit the latch bolt to be retracted. Thus, the latch bolt can be retracted from the inside location whether the locking rod is in its locking or unlocking position, but cannot be retracted from the outside location when the locking rod is set in its locked position.

43 Claims, 14 Drawing Sheets

26b
182b
184b
52b
160b
36b
168b
56b
60b
190
192
38b
50b
42b
24b
64b

LATCHING ASSEMBLY WITH PANIC RELEASE

CROSS-REFERENCE TO RELATED APPLICATIONS

This application is being filed concurrently with two other patent applications, namely, "ADJUSTABLE STRIKER PLATE ASSEMBLY" and "MULTI POSITION LATCHING ASSEMBLY", having the same inventor as the present application, and the subject matter of these two other concurrently filed applications is hereby incorporated by reference.

FIELD OF THE INVENTION

The present invention relates to latching assemblies, such as those used to maintain doors in a closed position, and more particularly to the locking and release mechanism for such latching assemblies.

BACKGROUND ART

In U.S. Pat. No. 3,121,319 (the inventor being the same as in the present invention), there is shown a lockable latching assembly, where there is a latch bolt which is urged outwardly by a compression spring, with the latch bolt being retracted by operation of a slide bar which is in turn connected to oppositely positioned push buttons. The slide bar has two sets of cam faces positioned at approximately a 45° angle to the lengthwise axis of the slide bar. When the slide bar is moved in either direction, one of these sets of cam faces acts on protrusions at the inner end of the latch bolt to retract the latch bolt. To lock the latch assembly, there is provided a locking rod that is mounted for a limited rotation within the slide bar. In one position, this locking rod permits the latch bolt to freely retract, with the locking rod fitting in a gap between two protruding members attached to legs of the latch bolt. On the other hand, when the locking rod is rotated 90° to a locking position, the greater width dimension of the locking rod blocks the retracting movement of the latch bolt. On one side of the latching assembly, the locking rod is rotated by a lock barrel that is operated by a key. On the other side of the latching device, the locking rod is moved from its locked to its unlocked position simply by rotating the push button.

Usually, the side of the device that has the lock barrel is positioned at some exterior location (e.g., outside of the building, or on the outside of a room), while the other push button (which we will call the "inside" push button) is located within a room or within a structure. As indicated above, as disclosed in U.S. Pat. No. 3,121,319, to retract the latch from an inside location so that the door can be opened, it is necessary to first have the inside button positioned so that the locking rod is in the unlocked position.

Such locking devices have been manufactured commercially for a number of years and have operated quite satisfactorily. However, there is a requirement for improvement, and this relates to what may be called the "panic release" situation. If a person is operating the latching device from the inside, and if there is some emergency (e.g., smoke or a fire), the person may not have the presence of mind to make sure that the inside push button is in the unlocked position. To alleviate this situation, it is desirable that the person on the inside be able to unlatch the door simply by pushing the button, regardless of whether or not the push button is in the locked or unlocked position. Yet this must be accomplished in a manner to prevent a person on the "outside" from unlatching the latched assembly without a key.

Also in U.S. Pat. No. 3,121,319, there is a resilient spring device to yieldingly position the locking rod in its locked and unlocked position. This is accomplished by providing the locking rod with flat surface portions that engage spring members which yieldingly hold the locking rod in its two operating positions, while permitting 90° rotation of the locking rod. The present invention is also intended to provide an improved locating spring assembly for the locking assembly.

The present invention is directed toward these problems, and the structure and function of the latching assembly of the present invention is in many respects quite similar to that of U.S. Pat. No. 3,121,319.

A search of the prior art has disclosed other latching devices of interest, and these will be discussed below.

U.S. Pat. No. 2,960,858 (the inventor being D. E. C. Webster, the inventor herein) discloses a latching device, the basic operation of which is rather similar to the above-mentioned U.S. Pat. No. 3,121,319.

U.S. Pat. No. 2,092,225—Schreiber shows a door latch system where there are slanted cam faces that force the bolt inwardly to the retracted position.

U.S. Pat. No. 2,058,163—Malone shows a door latching system where there are two slanted cam-like elements that operate to retract the bolt. The cam rod 31 is operated by the handle on the key side, and the dual cam members 31 are operated by the handle on the other side.

SUMMARY OF THE INVENTION

The present invention is an improvement over the latching assembly shown in U.S. Pat. No. 3,121,319. As indicated previously herein, the latch bolt assembly of the present invention is designed to operate effectively in the "panic release" situation, where the person is at an inside location, with the latching assembly being in a locked position, and yet the person can cause the latch bolt to be retracted simply by operating an inside actuating member in a normal fashion.

The latching assembly is adapted to be mounted to a door, and this assembly has a front end, a rear end, a lateral end, a longitudinal front-to-rear axis, and a transverse axis which is perpendicular to the longitudinal axis. There is a housing structure. There is also an actuating subassembly which comprises a latch bolt mounted in the housing structure. The latch bolt is movable along the transverse axis between an extended position and a release position.

The actuating subassembly further comprises a slide bar means mounted in the housing structure for movement along the longitudinal axis from an intermediate position to either a forward position or a rear position. The slide bar means has an operative connection to the latch bolt in a manner that with the slide bar means in the intermediate position, the latch bolt means is in the extended latching position. Movement of the slide bar means to either of the forward and rear positions causes the latch bolt means to move to the retracted, release position. There is a forward actuating member operatively connected to the slide bar means and positioned at a foward end of the assembly to be pushed rearwardly to move the slide bar means rearwardly to retract the latch bolt means. Normally, the forward actuating member would be at an "outside" location. There is a rear actuating member having an operative connection to the slide bar means and positioned at a rear end of the assembly to be pushed forwardly to move the slide bar means forwardly to retract the latch bolt.

A locking means is mounted in the assembly for movement between a locking position and an unlocking position. The locking means is characterized in that in the locking position the locking means prevents retraction of the latch bolt resulting from either a rearward push against the forward actuating member or from a forward pulling force exerted on the forward actuating member.

The rear actuating member has an operative connection to the locking means in a manner that a forward push on the rear actuating member causes the locking means to become at least partially released so as to permit forward movement of the slide bar means to retract the latch bolt. Thus, with the locking means in the locking position, the latch bolt is not able to be retracted by either a rearward push against, or a forward pull on, the forward actuating member, but the latch bolt is retracted by a forward push on the rear actuating member, regardless of whether the locking means is in the locking or unlocking position.

In the preferred form, the locking means comprises a locking rod means rotatably mounted in the assembly for movement between the locking and unlocking positions, with the locking rod means extending along the longitudinal axis. The locking rod means is operatively connected to the forward and rear actuating members in a manner that rotation of at least a portion of either of the forward and rear actuating members moves the locking rod means between the locking and unlocking positions.

In accordance with one embodiment, the locking rod means has a blocking portion which, with the locking rod means in the locking position, prevents movement of the actuating subassembly to retract the latch bolt. The locking rod means is responsive to forward movement of at least a portion of the rear actuating member to move the locking rod means to where the blocking portion no longer prevents movement of the actuating subassembly so as to retract the latch bolt. With the locking rod means in the locking position, and with the slide bar means in the intermediate position, the blocking portion of the locking rod means is in a blocking position located adjacent to the inner end of the latch bolt means so as to prevent retraction of the latch bolt means. The rear actuating member and the locking rod means are arranged so that forward movement of the rear actuating member causes movement of the locking rod means to move the blocking portion of the locking rod means out of its blocking position, in a manner that further forward movement of the rear actuating member causes the slide bar means to retract the latch bolt means.

The locking rod means in the preferred form has a reduced width portion which, when adjacent to the latch bolt means, permits movement of the latch bolt means to the retracted position, and an expanded width portion which comprises the blocking portion. The assembly is characterized in that the blocking portion is located, with the slide bar means in the intermediate position, in alignment with the latch bolt means along the transverse axis. Thus, movement of at least a portion of the rear actuating means forwardly moves the blocking portion out of lateral alignment with the latch bolt means and places the reduced width portion of the locking bar means in alignment with the latch bolt means. The locking bar means has a connection to the forward actuating member which permits at least limited forward to rear movement of the locking rod means relative to the forward actuating means.

In accordance with another embodiment, the locking rod means is operatively connected to the front actuating member, and the locking rod means has a stop surface adapted to engage a matching stop surface in the assembly when the locking rod means is in its locking position and said forward actuating means is pushed rearwardly.

Further, the locking means in another embodiment also comprises stop finger means operatively connected to the slide bar means and movable between a restraining and an unrestraining position. The stop finger means is characterized in that with the stop finger means in the restraining position, forward movement of the slide bar means is prevented. The stop finger means has an operative connection with the rear actuating member in a manner that an initial forward movement of the rear actuating member moves the stop finger means to its unrestraining position.

In the preferred form, the stop finger means is mounted in a rear portion of the slide bar means in a manner that the stop finger means is normally positioned in its restraining position. The stop finger means is arranged to be engaged by the rear actuating member in a manner that initial movement of the rear actuating member moves the stop finger means to its unrestraining position in the slide bar means, and further forward movement of the rear actuating member causes forward movement of the slide bar means.

Further, in the preferred form, the stop finger means has associated spring means engaging the stop finger means to urge the stop finger means to its restraining position. The stop finger means is mounted for limited rotational movement in a manner that engagement with the rear actuating member causes limited rotation of the stop finger means against urging of the spring means to move the stop finger means to the unrestraining position.

In this specific embodiment, the stop finger means comprises a mounting plate portion mounted in the rear end of the slide bar means. The stop finger means in the restraining position extends outwardly from a center axis of the slide bar means, and the spring means acting against the mounting plate means urges the stop finger means to its restraining position. The rear actuating means is arranged to engage the mounting plate means to cause rotation thereof to move the stop finger to the unrestraining position.

In accordance with another facet of the present invention, the locking rod means is provided with a locking rod positioning means arranged to yieldingly hold the locking rod means in either of the locking or unlocking positions. This locking rod positioning means comprises a first positioning member having raised and recessed portions and being mounted so as to be rotatable with the locking rod means. It also comprises a second positioning member having raised and recessed portions matching with the raised and recessed portions of the first positioning member and positioned so as to be non-rotatable with respect to the locking rod means. The first and second positioning members are interengaged with one another in a manner that with the locking rod means in either of its locking and unlocking positions, the raised and recessed portions of the first and second positioning members are in matching engagement, while with the locking rod means in an intermediate position between the locking and unlocking positions, the raised and recessed portions of the first and second positioning members are out of matching engagement so as to urge the locking rod means to remain in either of the locking and unlocking positions. In the preferred form, there is a positioning spring member yieldingly urging the first and second positioning members into engagement with one another.

In the preferred form, the positioning members are plate-like members which have the raised and recessed portions arranged in a circumferential pattern around a center location, with the raised and recessed portions extending radially outwardly from the center location.

Other features of the present invention will become apparent from the following detailed description.

DESCRIPTION OF THE PREFERRED EMBODIMENTS

Figure 1:
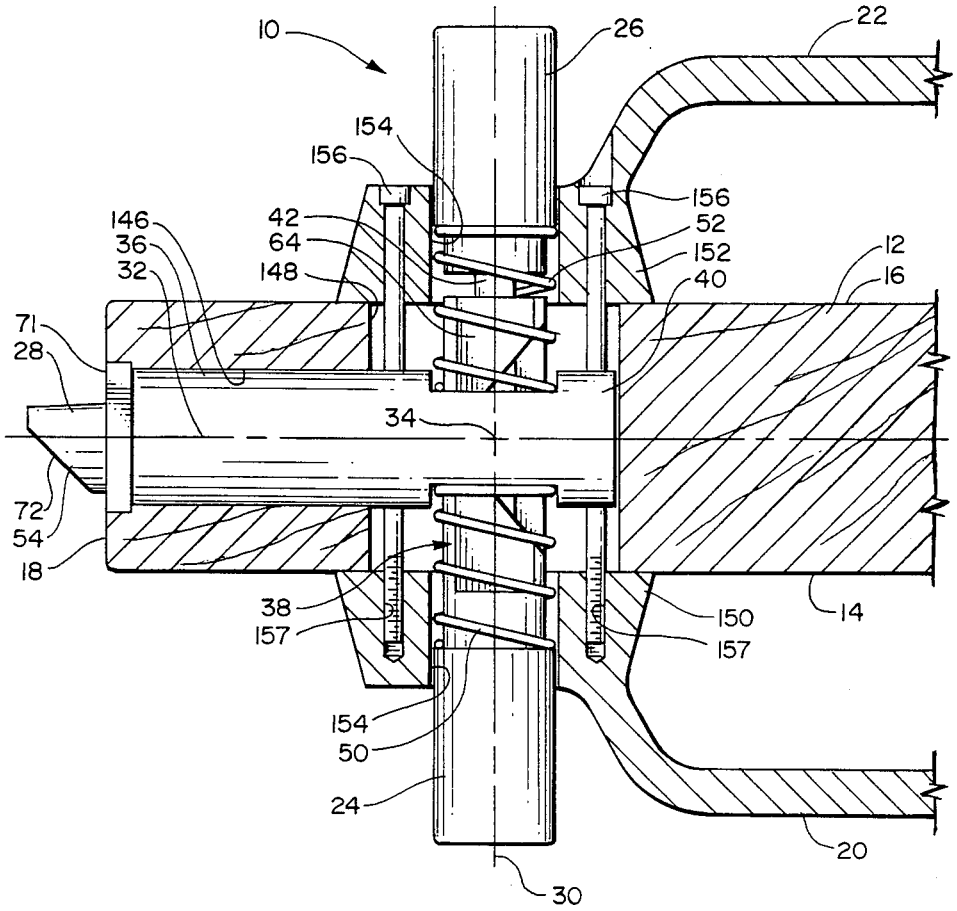
FIG. 1 is a plan view, partly in section, illustrating the latch assembly of the present invention mounted in a door.

With reference to FIG. 1, the locking assembly 10 of the present invention is shown being mounted to a vertical edge portion of a door 12. For purposes of description, the door 12 will be considered as having a front side or surface 14, a back side or surface 16, and an edge side or surface 18 adapted to be positioned against a door jam. The door 12 would normally be hinge mounted about its vertical edge portion that is positioned opposite to the edge side or surface 18.

As indicated previously, the latch assembly of the present invention is an improvement over the latch assembly shown in U.S. Pat. No. 3,121,319, the inventor being the same as the inventor in the present invention. It is believed that a clearer understanding of the inventive features of the present invention will be obtained by first describing the structure and function of the main operating components of the present invention which are substantially the same as in U.S. Pat. No. 3,121,319, and also discussing the general mode of operation of those components. After that, there will be a more detailed discussion of the components which have been modified or added to provide the combination of the present invention.

With further reference to FIG. 1, the locking assembly 10 comprises front and rear stationary handles 20 and 22, respectively, which can be grasped in the person's hand for either a pulling or pushing motion. In addition, there are forward and rear actuating buttons or cylinders 24 and 26, respectively. These buttons 24 and 26 are placed adjacent to their respective handles 20 and 22 so that the buttons 24 or 26 can conveniently be depressed by the person's thumb as the person is grasping the handle 20 or 22. By depressing either of the buttons 24 or 26 in an inward direction (i.e., toward the door 12), a latch bolt 28 of the latching assembly can be retracted.

For purposes of description, the latching assembly 10 will be considered as having a forward to rear longitudinal center axis 30 (see FIG. 1) which passes through the longitudinal center lines of the two actuating buttons or cylinders 24 and 26. Also, there is a transverse axis 32 (see FIG. 1) which extends horizontally perpendicular to the longitudinal axis 30, this transverse axis 32 being centered along the lengthwise axis of the latch bolt 28. The intersection 34 of the two axes 30 and 32 shall be considered the center of the latch assembly 10. The terms "inner" or "inwardly" shall denote proximity to or travel toward the center point 34, while the terms "outer" or "outwardly" shall denote a location further from or travel away from the center point or location 34.

Figure 2:
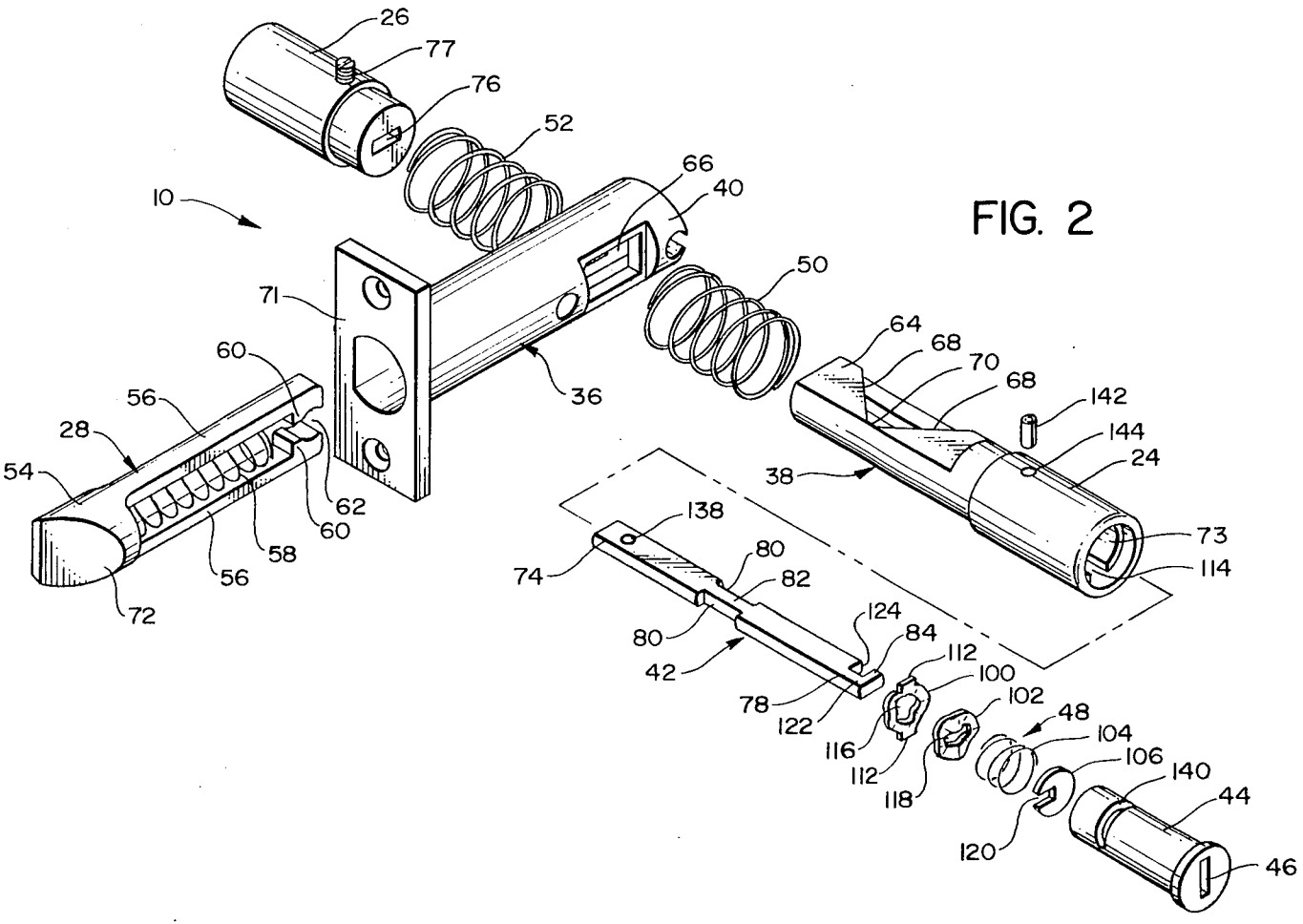
FIG. 2 is an isometric, exploded view showing the main components of the latch assembly.

The main components of the latch assembly 10 are best illustrated in FIG. 2, and it can be seen that these components comprise the aforementioned first and second actuating buttons 24 and 26, and also the latch bolt 28. Further, this latch assembly 10 comprises a latch case or housing 36 in which the latch bolt 28 is positioned for limited back and forth movement along the transverse axis 32.

There is also a slide bar 38 which is positioned in, and extends through, the inner end portin 40 of the latch case 36. As will be described more fully hereinafter, the primary function of this slide bar 38 is to retract the latch bolt 28 to its retracted or unlatched position within the latch case 36 by movement of the slide bar 38 either forwardly or rearwardly, in response to inward pressure against either the rear or forward actuating button 26 or 24, respectively. The forward end of the slide bar 38 is fixedly connected to the forward button 24, while the rear end of the slide bar 38 does not have a direct connection to the rear button 26.

Figure 8:
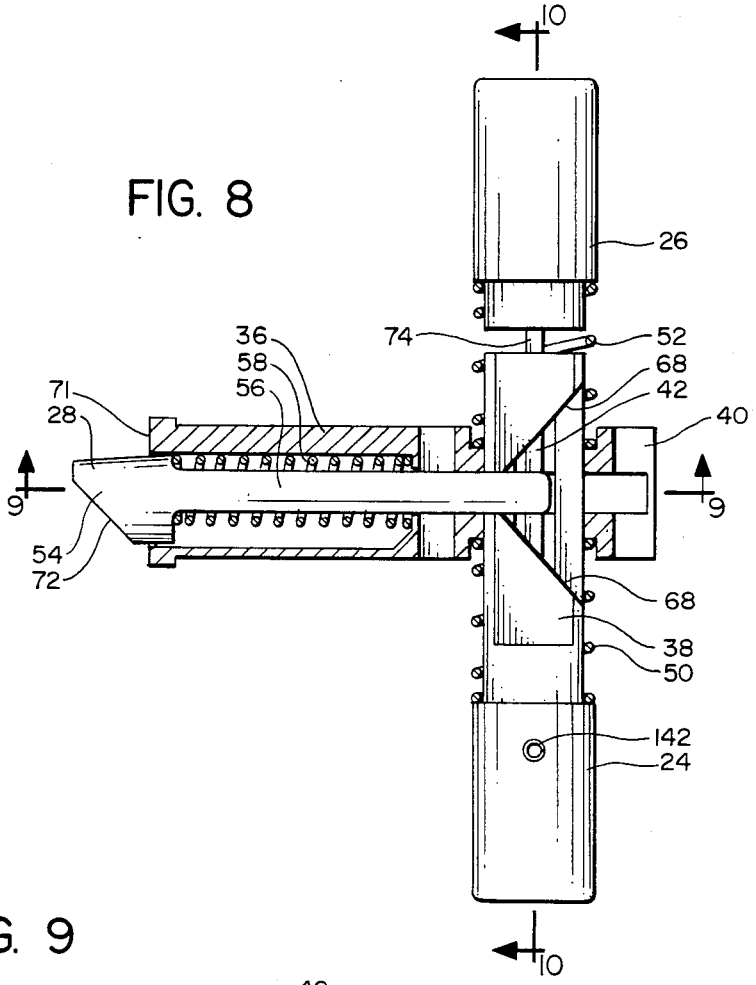
FIG. 8 is a view similar to FIG. 3, except that the locking rod is shown in its locking position.
Figure 9:
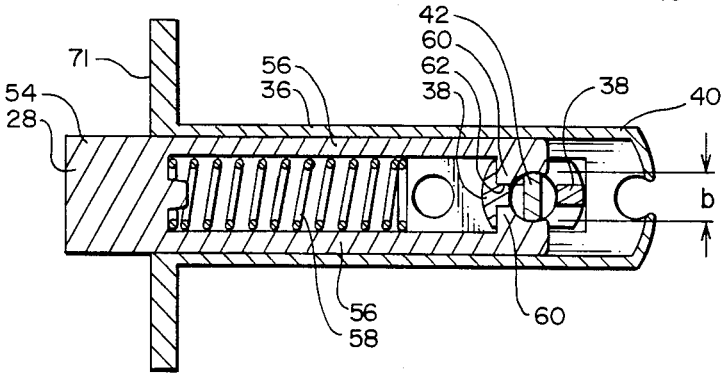
FIG. 9 is a sectional view taken along line 9—9 of FIG. 8.

Still with reference to FIG. 2, the latch assembly 10 further comprises a locking rod 42. This locking rod 42 is positioned within the slide bar 38 and is rotatably mounted therein for limited (i.e., 90°) rotation about the longitudinal axis 30. When the plane of the locking rod 42 is generally horizontal (as shown in FIG. 2, as well as in FIGS. 3–6), the locking rod 42 is in its unlocked position. When the locking rod 42 is rotated from the horizontal position 90° so that the plane of the locking rod 42 is vertically oriented, as shown in FIGS. 8 and 9, the rod 42 is in its locking position.

At this point of the description, it may be helpful to point out that the configuration of the locking rod 42 is particularly critical to the combination of the first embodiment of the present invention, and this locking rod 42 is modified from that shown in the aforementioned U.S. Pat. No. 3,121,319. On the other hand, the latch bolt 28, latch case 36 and slide bar 38 are or may be substantially similar in structure and basic function as the corresponding components shown and described in U.S. Pat. No. 3,121,319.

Still with reference to FIG. 2, there is a lock barrel 44 which is positioned inside the front actuating button or cylinder 24. This lock barrel 44 has a key slot 46 to receive a key which enables the lock barrel 44 to be rotated so as to move the locking rod 42 between its locking and unlocked position. The rear actuating button or cylinder 26 is fixedly connected to the rear end of the locking rod 42 so that rotation of the rear button or cylinder 26 can also move the locking rod 42 between its locking and unlocked position.

Also shown in FIG. 2 is a locating spring assembly 48 which is positioned within the forward actuating cylinder 24 and functions to yieldingly hold the locking rod 42 in its two operating positions, namely the locking and the unlocked position. This locating spring assembly 48 is also believed to be a significant feature of the present invention, and this will be described more fully later herein.

Finally, there is shown in FIG. 2 forward and rear compression springs 50 and 52, respectively, which are positioned between the forward and rear actuating cylinders 24 and 26, respectively, and the inner end portion 40 of the latch case 36. The spring 50 urges the slide bar 38 forwardly, while the rear spring 52 urges the rear button 26 rearwardly which in turn acts through the locking rod 42 to urge the slide bar 38 rearwardly.

To further describe the main components of the present invention, reference is now made to FIGS. 3–6, in addition to FIG. 2.

The latch bolt 28 comprises an outer latching end 54 and two inwardly extending upper and lower legs 56, positioned one above the other. Between the legs 56 is positioned a latch spring 58, which is a compression spring that urges the latch bolt 28 outwardly to its latching position.

The inner ends of the two latch bolt legs 56 have laterally extending protrusions 60, with one protrusion 60 extending downwardly from an upper leg 56 and the other extending upwardly from the lower leg. These protrusions 60 have both an actuating function and a locking function. In the actuating function, these protrusions 60 cooperate with the slide bar 38 to retract the latch bolt 28 against the urging of the compression spring 58. For the locking function, these protrusions 60 cooperate with the locking rod 42 to prevent retraction of the latch bolt 28. With regard to the latter function (i.e., the locking function), these protrusions 60 define a through slot 62 which receives therein the locking rod 42 (when the rod 42 is in its horizontal unlocked position) as the latch bolt 28 is retracted into the latch case 36. However, this slot 62 is not large enough to receive the locking rod 42 when the locking rod is in its vertical locking position (as shown in FIGS. 8 and 9), so that the locking rod 42 prevents the retraction or inward movement of the latch bolt 28.

The slide bar 38 has upper and lower flat surfaces 64 contoured so that the slide bar 38 can fit within a longitudinally extending through slot 66 formed in the inner end portion 40 of the latch case 36. At the upper and lower slide bar surfaces 64, the slide bar 38 is formed with two V-shaped recesses defined by slanted cam faces 68. These cam faces 68 meet at a flattened apex location 70 and diverge in an inward direction away from one another at angles of about 45° from the longitudinal axis 30. These cam faces 68 engage the protrusions 60 at the inner end of the latch bolt 28 in a manner that forward or rearward movement of the slide bar 38 from its intermediate position causes the latch bolt 28 to retract.

Figure 3:
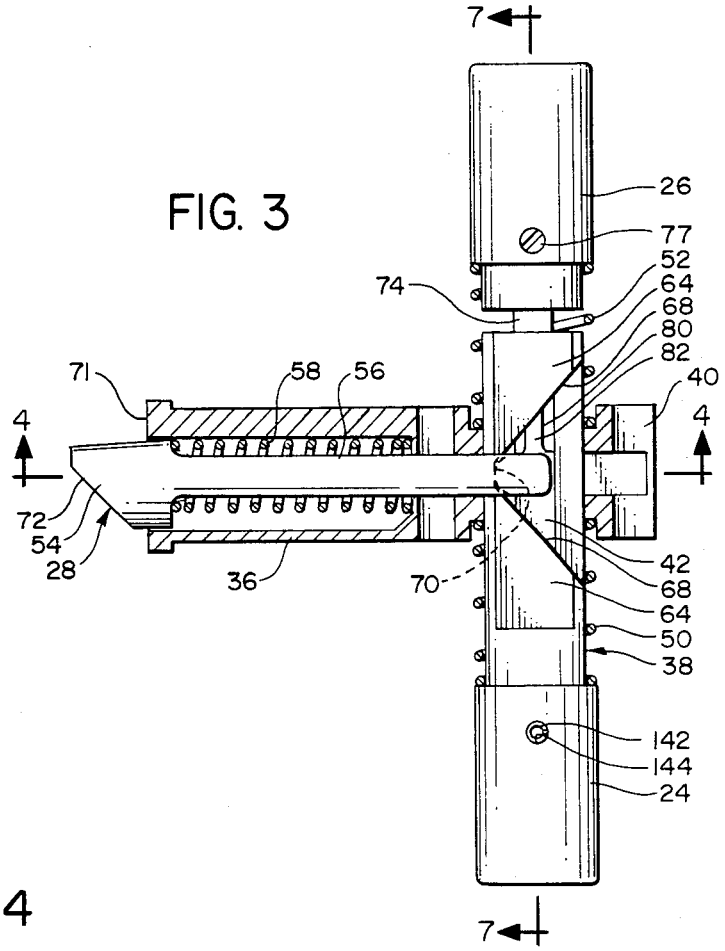
FIG. 3 is a view similar to FIG. 1, showing the latch assembly in plan view, with the latch case in section, and showing the latch actuating sub-assembly in the intermediate or latching position.
Figure 4:
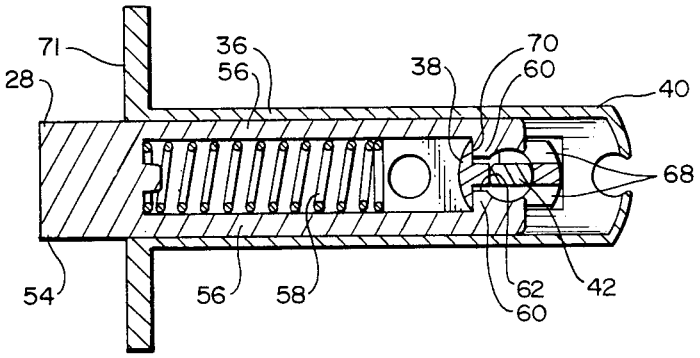
FIG. 4 is a sectional view taken along line 4—4 of FIG. 3.

At this point, there will be a brief review of the basic latching and unlatching movement of the assembly 10. With reference to FIGS. 3 and 4, it can be seen that the slide bar 38 is in an intermediate position, so that the protrusions 60 of the latch bolt legs 56 are positioned at the apex location 70 of the two V grooves formed by the cam faces 68. The latch bolt compression spring 58 urges the latch bolt 28 outwardly so that the outer latching end 54 extends a moderate distance beyond the outer end 71 of the latch case 36. In this position, if the door 12 is moved from an open position to a closed position, a slanted surface 72 (i.e. a contact surface 72) of the latch bolt end portion 54 engages a striker plate in the door jam so that the latch bolt 28 is moved inwardly against the urging of the spring 58, with the latching end 54 being permitted to spring outwardly into a matching opening in the striker plate so that the door 12 is now held in its closed position by the outwardly extending latch bolt end portion 54 engaging the striker plate opening.

Figure 5:
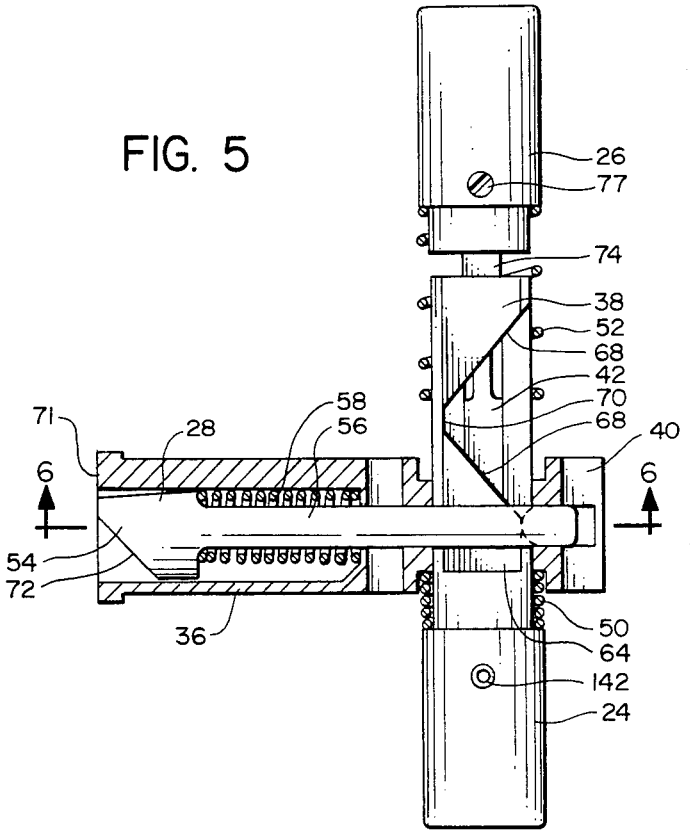
FIG. 5 is a view similar to FIG. 3, but showing the latch bolt in its retracted position.
Figure 6:
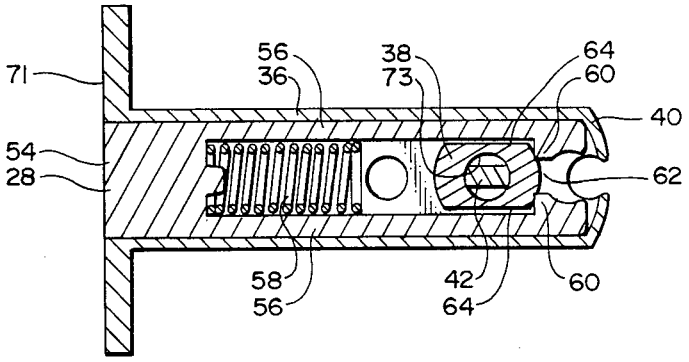
FIG. 6 is a sectional view taken along lines 6—6 of FIG. 5.

To retract the latch bolt 28, either of the two actuating buttons 24 or 26 is depressed inwardly toward the door so as to move the slide bar 38 from its intermediate position rearwardly or forwardly, respectively, to cause one set of upper and lower cam faces 68 to engage the inner latch bolt protrusions 60 and retract the latch bolt 28. In FIGS. 5 and 6, the latch bolt 28 has been moved to its retracted position by pushing the forward button 24 inwardly.

With the locking rod 42 in its unlocked position, the latch assembly 10 functions substantially as described above. At this point, without discussing specifically the structure and detailed operation of the locking rod 42, let us examine some of the basic functions of this locking rod 42. As a preliminary consideration, let it be assumed that the front side 14 of the door 12 is the "outside", and that the back side 16 of the door 12 is adjacent to the "inside", and it is desired to have the locking mechanism of the latch assembly 10 operate so that a person on the "outside" can only enter with a key when the assembly 10 is locked. On the other hand, a person on the "inside" of the door 12 should have a convenient means of locking and unlocking the door without a key. In the present invention, and also in the mechanism of the aforementioned U.S. Pat. No. 3,121,319, the person on the "inside" unlocks the assembly 10 by rotating the back (now "inside") button or cylinder 26 ninety degrees (90°), so that this in turn rotates the locking rod 42 to the unlocked position. The person on the front side of the door (i.e., the "outside") requires a key that is inserted into the lock barrel 44 and rotated so as to rotate the lock barrel 44 and in turn rotate the locking rod 42 to its unlocked position.

Now let us further consider the "panic release" situation which might occur at the "inside" location. Let it be assumed, for example, that the door 12 is a bathroom door or a bedroom door, and while the person is inside that room, a fire starts. The person inside the room may not have the presence of mind to realize that the rear or "inside" button or cylinder 26 is in the locked position, and that it needs to be turned to the unlocked position. Thus, it would be desirable to have the "inside" button or cylinder 26 arranged so that an inward push of this button or cylinder 26, either in the locked or unlocked position, would open the door. This is called the "panic release" situation.

On the other hand, consideration must also be given to the security of the latching assembly. Even though it is desired to enable the person on the "inside" to be able to unlatch the assembly 10 under any circumstances, it is desired that this same accommodation not be made for the person on the "outside" who is to gain admittance only under circumstances where that person has a key.

It is to the above problem that one major aspect of the present invention is particularly directed, and with the foregoing as background information, there will be further discussion as to the locking rod 42 and its associated components.

With reference to FIG. 2, the locking rod 42 is positioned within a chamber or bore 73 provided in the slide bar 38, so as to be rotatable therein. The rear end 74 of the locking rod 42 is received in a slot 76 in the rear actuating cylinder 26 and held fixedly therein by a screw 77. The forward end 78 of the locking rod 42 is received in the aforementioned lock barrel 44, but this is not a totally rigid connection. Rather, the locking rod 42 has somewhat limited fore and aft movement in the lock barrel 44, and this will be described later herein with reference to FIGS. 10–12. Also, the manner in which the locking rod 42 is rotated by rotation of the lock barrel 44 will be described later herein with reference to FIGS. 15–19.

Further, it will be noted that at a mid location of the locking rod 42, there are two notches 80 which provide a reduced width portion or "necked" portion 82 of a width dimension no greater than the thickness dimension of the locking rod 42. (The "width" dimension of the rod 42 is considered to be that lateral dimension which is greater than the other lateral dimension of the rod 42, which is the "thickness" dimension.)

Figure 7:
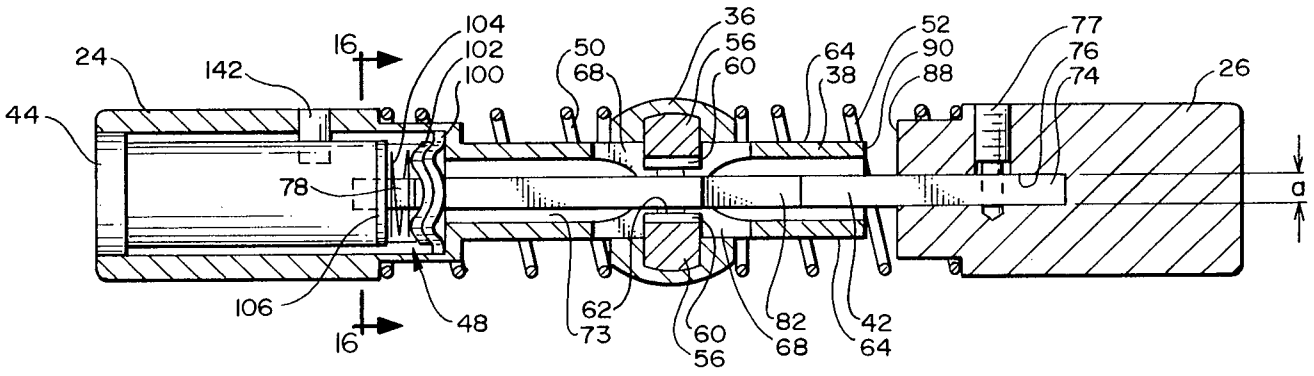
FIG. 7 is a longitudinal sectional view taken along a vertical plane coincident with the longitudinal axis, showing a locking rod of the present invention in its unlocked position.

With the configuration of the locking rod 42 now described, let us now examine further the locking function of this rod 42. FIG. 7 shows the locking rod 42 in its unlocked position, and it can be seen that the thickness dimension (indicated at "a" in FIG. 7) is sufficiently small so that the slot or gap 62 defined by the latch bolt leg protrusions 60 is able to receive the locking bar 42. Thus, the latch bolt 38 can be retracted without any interference from the lock bar 42.

However, as illustrated in FIGS. 8 and 9, when the locking bar 42 is rotated 90° to its locking position, the "width" dimension (indicated at "b" in FIG. 9) of the locking rod 42 is greater than the vertical dimension of the slot or gap 62 of the latch bolt protrusions 60, and this prevents the latch bolt 28 from retracting. Thus, if the front button or actuating cylinder 24 were pushed inwardly toward the door, the inward movement of the front button 24 would be blocked, since the upper and lower cam faces 68 that engage the protrusions 60 would not be able to cause retraction of the latch bolt 28.

Figure 10:
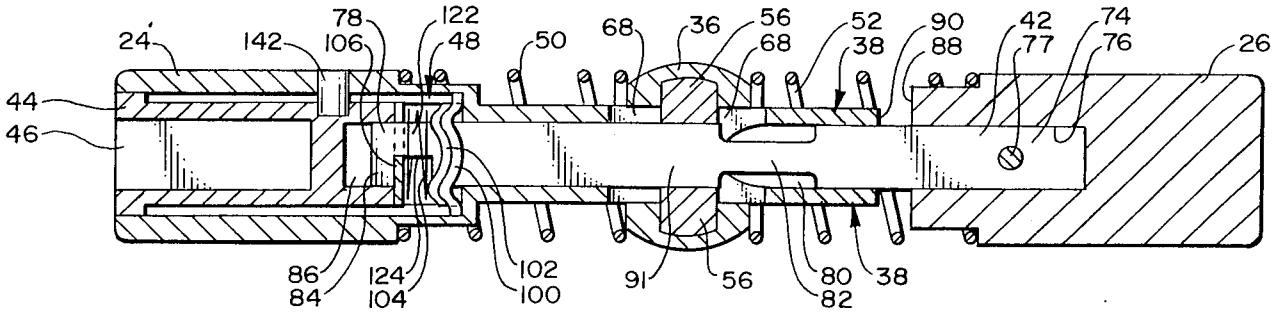
FIG. 10 is a sectional view taken along line 10—10 of FIG. 8, showing the locking rod in its locking position.

However, if the rear or "inside" button or cylinder 26 is depressed when the locking rod 42 is in its locked position, a somewhat different action results, and this will be described with reference to FIGS. 10–12. FIG. 10 illustrates the "neutral" or intermediate position of the slide bar 38, in which the slide bar 38 will normally be situated if there are no external forces applied. It will be noted that the rear or "inside" button or cylinder 26 is spaced a moderate distance rearwardly of the rear edge of the slide bar 38. The notched or reduced with portion 82 of the locking rod 42 is positioned just rearwardly of the protrusions 60 of the latch bolt legs 56. Thus, it can be seen that an inward push against the front cylinder or button 24 would immediately be stopped because of the action of the locking bar 42 preventing retraction of the latch bolt 28, and thus preventing any further rearward movement of the slide bar 38.

Figure 11:
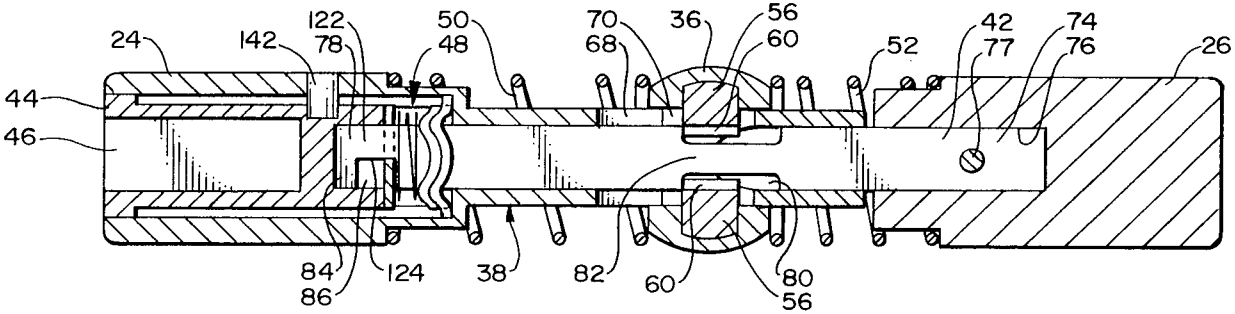
FIGS. 11 and 12 are views similar to FIG. 10, but showing the locking rod being moved to a release position by depression of the rear actuating button of the latch assembly.
Figure 12:
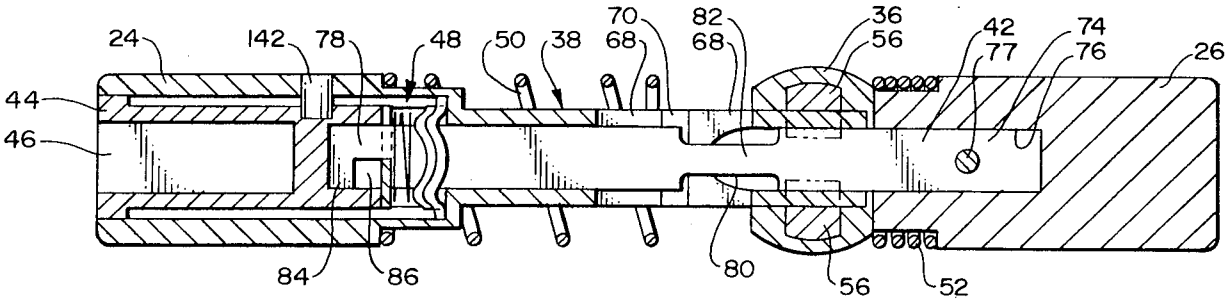

However, with reference to FIG. 11, let us assume that an inward push is directed against the rear button or cylinder 26. As indicated previously, the connection of the forward end 78 of the locking bar 42 permits limited fore and aft movement of the locking bar 42 relative to the lock barrel 44. (The lock barrel 44 is positioned within the front actuating cylinder or button 24 in a manner that it can be rotated therein, but is fixed thereto with regard to axial motion.) More specifically, the front end of the locking bar 42 has an outwardly extending finger 84 that slides fore and aft in a recess 86 defined in the lock barrel 44.

Thus, as illustrated in FIG. 11, the initial forward movement of the rear locking cylinder or button 26 causes the locking rod 42 to move forwardly so that the notched or reduced width portion 82 of the locking bar 42 comes into alignment with the latch bolt protrusions 60. At the same time, there has been no forward movement of the slide bar 38. The reason for this is that in the position of FIG. 10, the forward surface 88 of the rear actuating cylinder 24 is spaced a short distance rearwardly of the rear edge or surface 90 of the slide bar 38. Further, as indicated above, the connection of the forward end 78 of the locking rod 42 permits such limited movement. It now becomes evident that as the rear actuating cylinder 26 engages the slide bar 38 and causes it to move forwardly, the slide bar 38 is free to do so since the latch bolt protrusions 60 will simply pass through the notched portion 82 of the locking bar 42 which has come into transverse alignment with the latch bolt leg protrusions 60.

To examine another facet of the present invention, let us assume that there is a person positioned on the "outside" of the door 12 and this person wishes to open the locked latch assembly 10 by pulling on the button or cylinder 24. (A person might attempt to pull the cylinder or button 24 outwardly by grasping it with a pair of pliers or the like and pulling it.) Since the cylinder 24 is fixedly secured to the slide bar 38, as soon as the cylinder 24 is pulled outwardly, the rear cam faces 68 will immediately begin moving the latch bar legs 56 inwardly. However, since the locking rod 42 still has a full width portion aligned with the protrusions 60 of the latch bolt legs 56, the latch bolt 28 is not able to move inwardly further since the protrusions 60 will simply be blocked by the portion of the locking rod indicated at 91 in FIG. 10, no further outward movement of the cylinder or button 24 would be permitted.

Thus, whether the locking rod 42 is in the locked or the unlocked position, the inside or rear actuating button 26 can be pushed inwardly to unlatch the assembly 10 and permit the door 12 to be opened, so that the panic release problem is alleviated. On the other hand, the person on the outside is not able to unlatch the assembly unless it is first unlocked by a key.

The aforementioned spring assembly 48 will now be described with reference to FIG. 2, and also FIGS. 13–19. As indicated previously, the function of this spring assembly 48 is to yieldingly hold the locking rod 42 in either its locking or unlocked position. This spring assembly 48 comprises two generally circular, disc-like locating washers 100 and 102, a compression spring 104, and a retaining disc washer 106.

Each of the locating washers 100 and 102 has a "corrugated" or "warped" pattern relative to a circumferential path around the washer. More particularly, each washer 100 or 102 is bent moderately along eight radially extending bend lines 108, spaced 45° from one another. The bend lines 108 of each washer 100 or 102 are in a spaced alternating pattern, so that these bend lines 108 divide each washer 100 or 102 into eight "preshaped" segments 110 with each segment 110 being slanted from the general plane occupied by that washer 100 and 102 in a direction opposite to its two adjacent segments 110. Thus, it can be seen that as one views one face of the washer 100 or 102, there are four evenly spaced, radially extending ridges or raised portions located at the positions of alternately located bend lines 108, while the remaining bend lines 108 define the "valleys".

Figure 13:
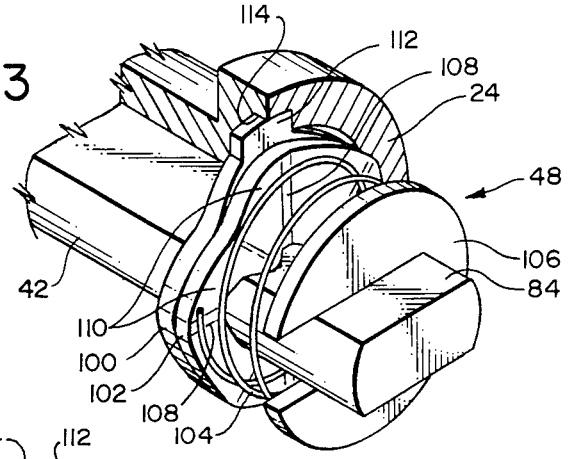
FIG. 13 is an isometric view of a spring-like locating mechanism to position the lock bar in either its locking or unlocked position, with the locking rod being shown in FIG. 13 in its unlocked position.
Figure 14:
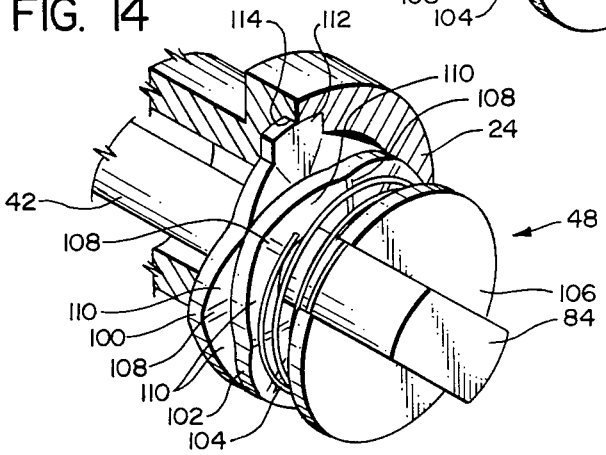
FIG. 14 is an isometric view similar to FIG. 13, but showing the locking rod moving from its unlocked to its locking position.

With reference to FIG. 13, it becomes apparent that when the "peaks" and "valleys" of the two washers 100 and 102 are positioned in matching engagement, the two washers 100 and 102 fit closely to one another. On the other hand, when the two washers 100 and 102 are moved from the matching position of FIG. 13 45° relative to one another (to the position of FIG. 14), the two washers 100 and 102 are pushed away from one another.

The first washer 100 has upper and lower tabs 112 that extend moderately outwardly from the circumference of the washer 100, and these fit into matching longitudinally extending slots 114 formed in the bore 73 of the push button 24. Thus, while the locating washer 100 can be moved longitudinally relative to the push button 24, it is constrained so as to be rotatably fixed to the push button 24. Also, the washer 100 has a central through opening 116 (see FIG. 2) which is shaped so as to permit relative rotation between the locking rod 42 and the washer 100 of at least 90°.

The other locating washer 102 is arranged so that it is rotatably fixed to the locking rod 42, and this is accomplished by providing the second washer 102 with a rectangular slot or opening 118 which matches and fits closely around the locking rod 42. Thus, it is apparent that as the locking rod 42 is rotated relative to the slide bar 38 and the actuating button 44, the two washers 100 and 102 rotate relative to one another.

The retaining disc 106 has a radial slot-like opening 120 which is arranged to receive a reduced width portion 122 of the locking rod 42. The retaining disc 106 fits in a slot 124 defined by the locking rod finger 84 and the reduced width portion 122. The longitudinal dimension of this slot 124 is greater than the thickness dimension of the retaining disc 106, so as to permit this relative longitudinal movement. Further, it can be seen that the forward side of the retaining disc 106 fits against the rear face of the lock barrel 44. The spring 104 presses from the retaining disc 106 against the washer 102 so as to urge the two washers 100 and 102 against one another.

It is apparent that in viewing FIG. 13, when the locking rod 42 is in the unlocked position, the washers 100 and 102 are in matching engagement, and rotation of the locking rod 42 towards its locking position will be resisted by what is in effect a cam action between the engaging surfaces of the two washers 100 and 102 and the action of the spring 104. On the other hand, after the two washers 100 and 102 are rotated 45° relative to one another, the two peak portions at 108 pass one another so that the washers 100 and 102 then slide into matching engagement in the locking position. In either the locking or the unlocked position, the two washers 100 and 102, being urged toward one another by the compression spring 104, yieldingly hold the locking rod 42 in either its locked or unlocked position.

Figure 15:
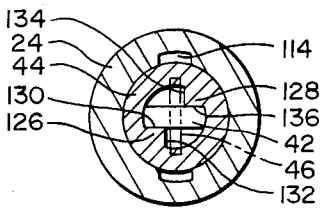
FIG. 15 is a sectional view taken at the location of line 16—16 of FIG. 7, showing the locking rod in its unlocked position.
Figure 16:
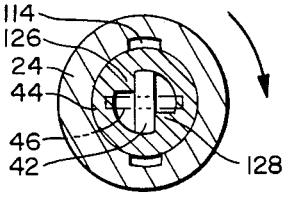
FIG. 16 is similar to FIG. 15 and also is taken along line 16—16 of FIG. 7, showing the locking barrel having been moved 90° to rotate the locking rod 90° to locate the locking rod in its locking position.
Figure 17:
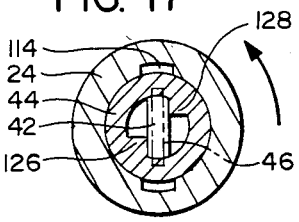
FIG. 17 is similar to FIGS. 15 and 16, but showing the locking rod being rotated in a direction opposite to that shown in FIG. 16, so as to engage the locking rod in preparation for moving it to its unlocked position.
Figure 18:
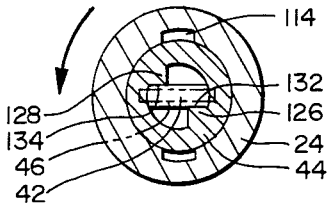
FIG. 18 is a view similar to FIGS. 15–17, and showing the locking barrel continuing its rotational path as shown in FIG. 17 and having moved the locking rod to its unlocked position.
Figure 19:
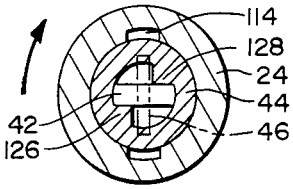
FIG. 19 is a view similar to FIGS. 15–18, showing the locking barrel returning to the position shown in FIG. 15.

To describe the manner in which the lock barrel 44 rotates the locking rod 42, reference is made to FIGS. 15–19. It can be seen in FIG. 15, that the locking rod 42 is in its unlocked position, and that the key hole slot 46 is vertically oriented. The lock barrel 44 has two dimetrically opposed inwardly extending protrusions 126 and 128. Each of these protrusions has two actuating surfaces 130 and 132, which meet each other at a right angle, and in a like manner the protrusion 128 has similar actuating surfaces 134 and 136. By rotating the lock barrel 44 counterclockwise (as seen in FIGS. 15 and 16), the locking rod 42 is engaged by the actuating surfaces 130 and 136 to rotate the locking rod 42 to the vertical position, as shown in FIG. 16. Then, as shown in FIG. 17, the locking barrel 44 is rotated clockwise to bring the key slot 46 back to the vertical position. To move the locking rod 42 to the unlocked position, the locked barrel 44 is rotated counterclosewise 90° from the position of FIG. 17 to the position of FIG. 18, with the actuating surfaces 134 and 132 engaging the locking rod 42 to cause such rotation. As illustrated in FIG. 19, the lock barrel 44 can then be rotated clockwise 90° to bring the key hole slot 46 back to the vertical position.

With regard to the assembly and installation of the latch assembly 10, it is believed that this should be readily understandable to one of ordinary skill in the art. Briefly, the locking rod 42 is inserted through the bore 73 in the slide bar 38 and the actuating button or cylinder 24. The slide bar 38, with the locking rod 42 therein is inserted through the opening 66 of the lock case 30. The rear end 74 of the locking rod 42 is inserted in the slot 76 of the rear actuating button 26, with the retaining screw 77 extending into an opening 138 in the locking rod 42 so as to properly retain the locking rod 42. The spring assembly 48 is assembled as illustrated in the drawings and placed in the forward actuating cylinder 24, as is the lock barrel 44. The lock barrel 44 is provided with a retaining slot 140 that is engaged by a pin 142 that fits through an opening 144 and into the slot 140. The slot 140 extends approximately 180° around the lock barrel 44 so as to permit the rotation of the lock barrel 44 as illustrated in FIGS. 15–19.

Prior to inserting the slide bar 38 into the opening 66, the latch bolt 28, with its compression spring 58 positioned therein, is inserted into the latch case 36, as illustrated in the drawings. The latch bolt 28 is pushed into its retracted position so that the slide bar 38 can be properly moved through the latch case opening 66, with the slide bar 38 properly positioned relative to the latch bolt.

To accomplish the assembling of the lock bolt assembly 10 in the door 12, as illustrated in FIG. 1, first, the latch case 36 with the latch bolt 28 and spring 58 is inserted in a laterally extending opening 146 in the doorway, and the remaining components inserted in the longitudinally extending opening 148 in the doorway. The handles 20 and 22 each have a base portion 150 and 152, respectively, each with a central through opening 154 to receive the latch assembly components. A pair of bolts 156 are inserted through openings in the base 152 of the handle 22, with the threaded ends of the bolts fitting in threaded sockets 157 in the base 150 of the handle 20.

A second embodiment of the present invention is illustrated in FIGS. 20–24. Components of this second embodiment which are similar to corresponding components of the first embodiment will be given like numerical designations, with an "a" suffix distinguishing those of the second embodiment.

Figure 20:
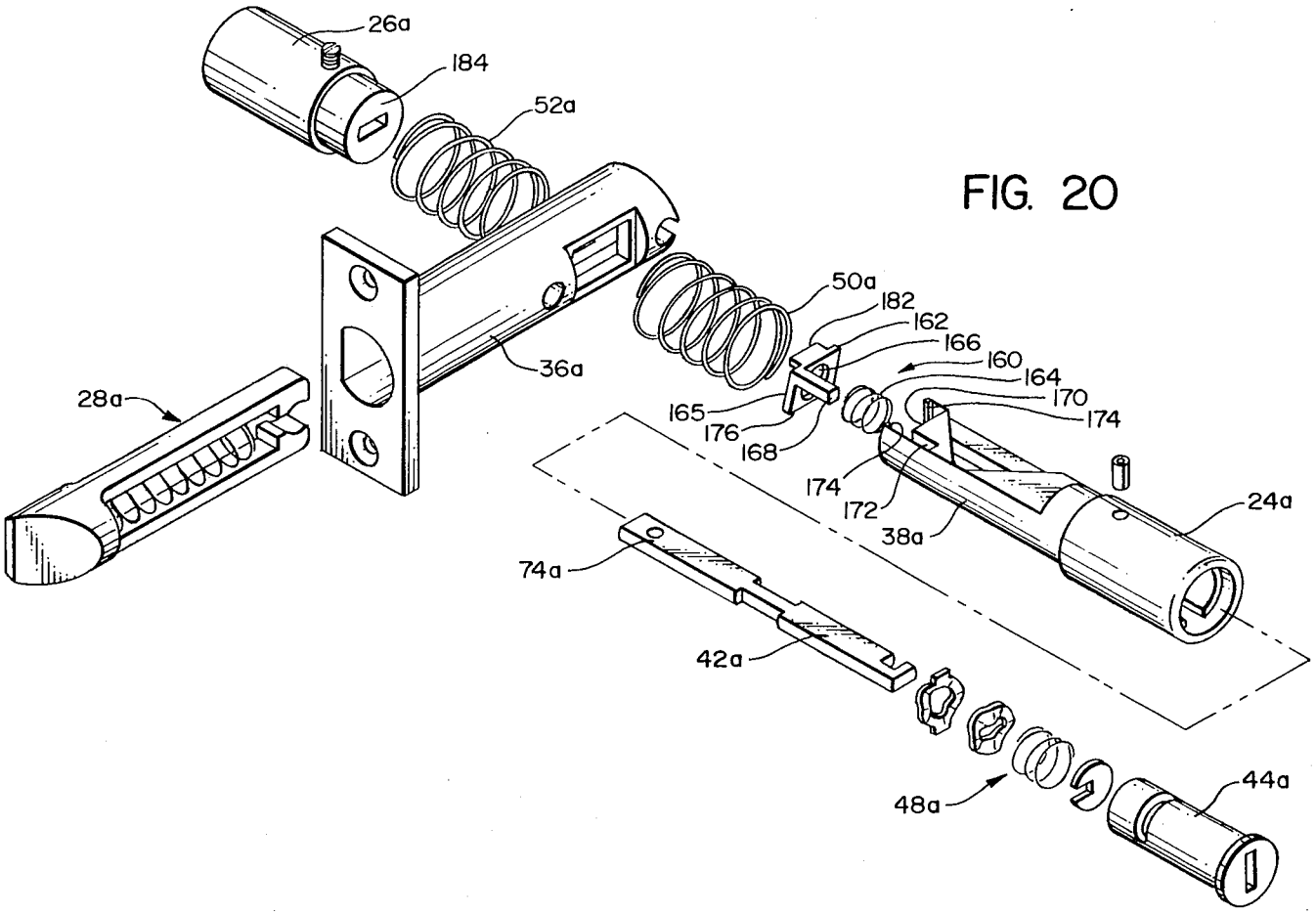
FIG. 20 is an exploded isometric view, similar to FIG. 2, showing a second embodiment of the present invention.
Figure 21:
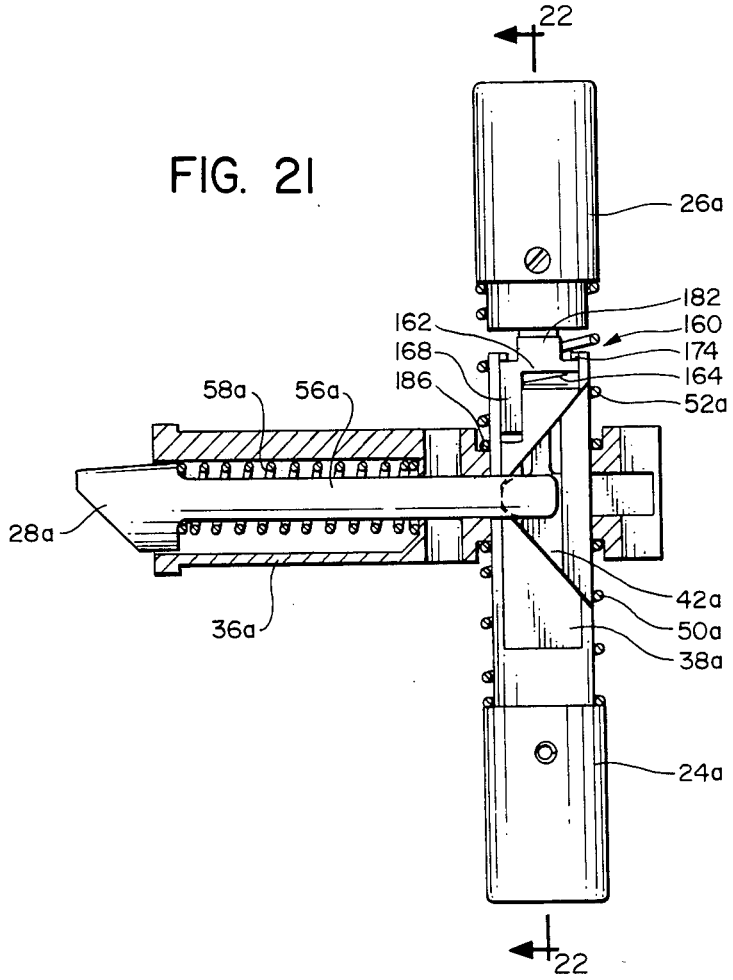
FIG. 21 is a plan view, partly in section, similar to FIG. 3, but showing the second embodiment illustrated in FIG. 20.

The second embodiment is substantially the same as the first embodiment, except that an additional restraining mechanism 160 is employed to prevent the slide bar **38*a* from being pulled in a forward direction (i.e., "outwardly" from the "outside" position). As illustrated in FIG. 20, there is the latch bolt 28*a*, a latch case 36*a*, a slide bar 38*a*, a forward push button 24*a*, a rear push button 26*a*, a locking rod 42*a*, a lock barrel 44*a*, a spring assembly 48*a*, and forward and rear positioning springs 50*a* and 52*a*, respectively. All of these components mentioned immediately above are substantially the same as in the first embodiment, except that a modification is made to the rear end of the slide bar 38*a* to accommodate the restraining mechanism 160**.

The restraining mechanism 160 comprises a restraining element 162 and a compression spring 164. The restraining element 62 comprises a square shaped plate-like portion 165 having a center through circular opening 166 to receive the rear end portion 74 of the locking rod **42*a* in a manner that the locking rod 42*a* can rotate within the center opening 166. The restraining element 162 further comprises a restraining finger 168 which extends forwardly from one of the upper corner portions of the plate-like portion 165**.

The rear end of the slide bar **38*a* is formed with a recess 170 to receive the plate-like portion 164, and is also formed with a longitudinally aligned slot 172 in which to receive the finger 168. This recess 170 is formed with inwardly extending lips 174 to retain the plate-like portion 164. Further, the compression spring 164 is positioned in the recess 170 forwardly of the plate-like portion 165 so as to urge the plate-like portion 165** rearwardly.

It will be noted that the forward and rear surfaces 178 and 180 (see FIG. 22) of the plate-like portion 165 are parallel to one another, and the restraining finger 168 is slanted upwardly from the planes defined by these surfaces 178 and 180 to a moderate degree so that it makes an angle with that portion of the surface 178 extending downwardly from the finger 168 slightly greater than a right angle. When the compression spring 164 pushes the plate-like portion 165 rearwardly against the vertically aligned flanges or lips 174, the rear surface 180 of the plate-like portion 165 becomes vertically aligned so that the finger 168 extends forwardly with a moderate upward slant. Thus, as can be seen in FIG. 22, the normal position assumed by the retaining element 162 is that the plate-like portion 165 is vertically aligned, while the finger 168 extends forwardly in a moderate upward slant so as to protrude above the upper surface **64*a* of the slide bar 38*a***.

Further, there is a release finger 182 which extends rearwardly from the upper edge of the plate-like portion 165. This finger 182 is positioned to be engaged by the rear actuating cylinder or push button **28*a***.

Figure 22:
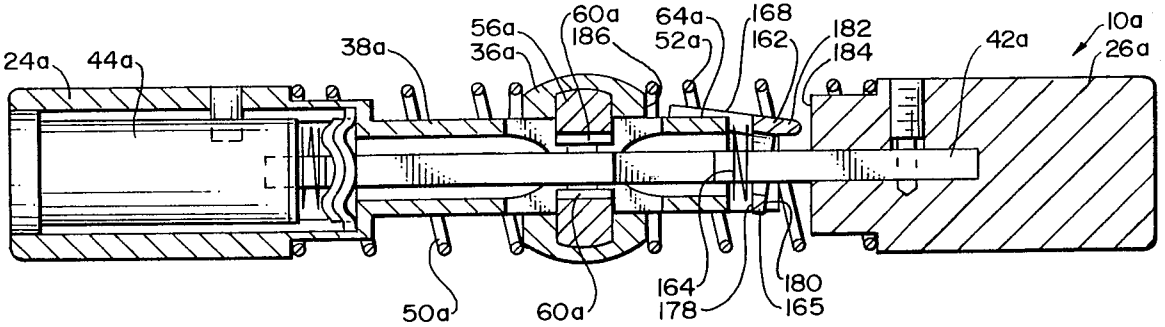
FIG. 22 is a sectional view taken along line 22—22 of FIG. 21, illustrating the second embodiment with the slide bar in its intermediate position.

To describe the operation of this second embodiment shown in FIGS. 20–24, reference is initally made to FIG. 22, which shows the latch assembly **10*a* positioned in its neutral position. For ease of illustration, the locking rod 42*a* is shown in its unlocked position (i.e., horizontally aligned). It will be noted that the rear actuating cylinder or button 26*a* is spaced moderately rearwardly of the release finger 182**.

Figure 23:
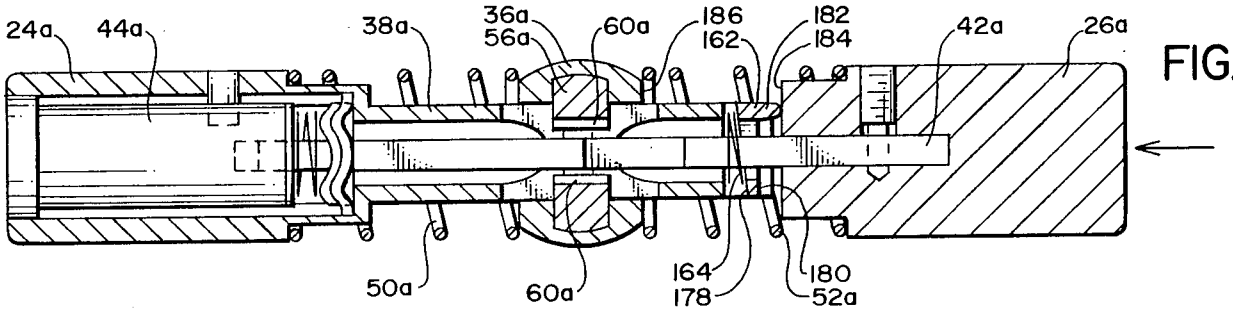
FIG. 23 is a view similar to FIG. 22, showing the rear actuating button being pushed inwardly to move a stop mechanism of the second embodiment to its non-locking position.

As illustrated in FIG. 23, let it be assumed that the person positioned at the rear side of the lock assembly **10*a* pushes the actuating button 26*a* in a forward direction. Because there is permitted limited axial movement between the locking rod 42***a* and the forward actuating button 24*a*, during the initial motion of the rear button or cylinder 26*a*, the slide bar 38*a* remains stationary. Thus, the forward surface 184 of the rear actuating cylinder 26*a* engages the release finger 182 to push against the upper portion of the plate-like portion 165 and cause the finger 168 to rotate downwardly. The reason for this is that the compression spring 164 will continue to push the bottom part of the plate-like portion 165 rearwardly. Thus, as can be seen in FIG. 23, the restraining finger 168 moves into the finger slot 172 so that the upper surface of the finger 168 is flush with the upper surface 64*a* of the slide rod 38*a*. Further forward movement of the rear push button 26*a* operates to retract the latch bolt 28 in the same manner as described with repsect to the first embodiment.

From the above description, it becomes evident that the release mechanism 160 permits a person on the inside location (i.e., at the rear face of the door) to push in the button 26*a* to retract the latch bolt 28*a* in the same manner as in the first embodiment. In other respects, the operation of the main components is the same as in the first embodiment when the rear button 26 is pushed.

Figure 24:
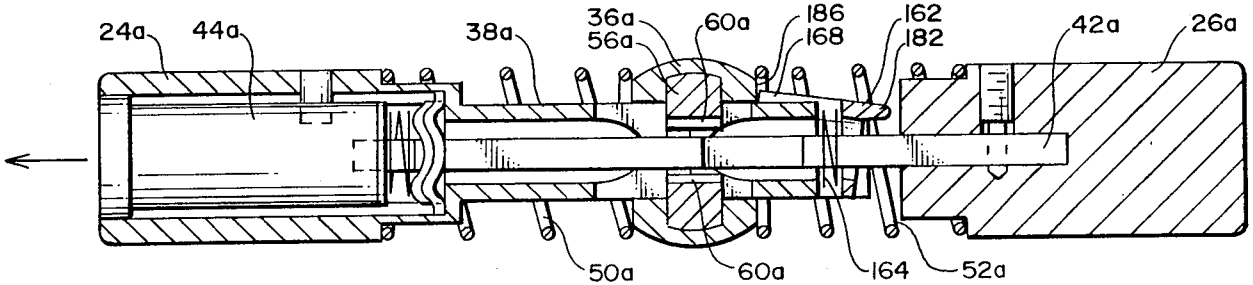
FIG. 24 is a view similar to FIG. 22, but illustrating the stop mechanism of the second embodiment operating in its locking position to prevent further forward lateral movement of the slide bar under circumstances where a pulling force is exerted on the forward actuating button or cylinder.
Figure 25:
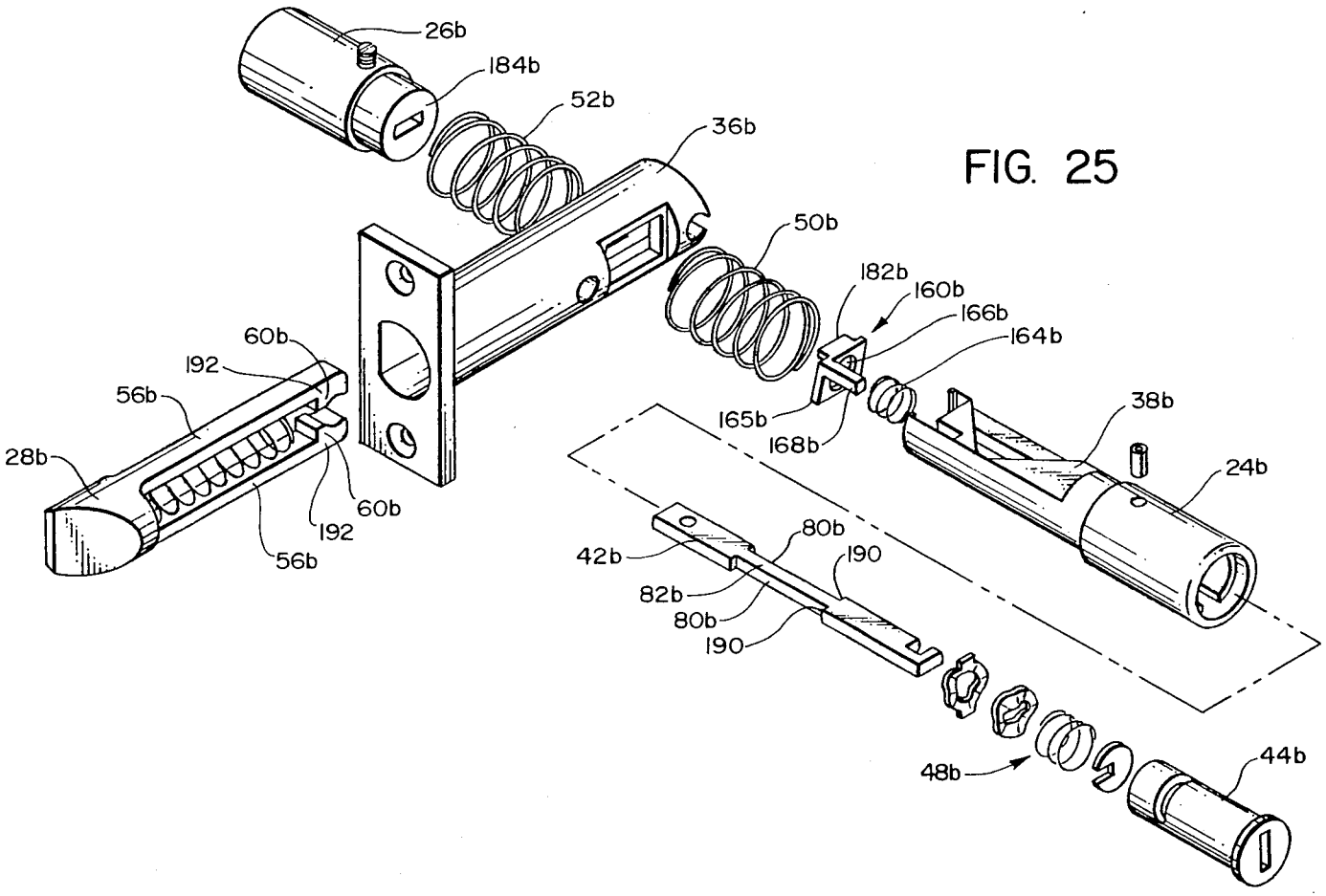
FIG. 25 is a view similar to FIGS. 2 and 20, showing a third embodiment of the present invention.

However, with reference to FIG. 24, let it now be assumed that a pulling force is exerted on the front actuating cylinder or button 24*a*. This could occur, for example, by a person grasping the front actuating cylinder or button 24*a* with a pair of plyers and pulling forwardly. If this were to occur, the result would be that the slide bar 38*a* would immediately begin moving forwardly, with the restraining finger 168 still in its forwardly and upwardly extending position. This would cause the restraining finger 168 to come in contact with the rear surface 186 of the lock case 36*a* so that further forward movement of the slide bar 38*a* would be prevented.

To comment further on the operation of this second embodiment, it will be recalled that in the operation of the first embodiment, a pulling motion on the front push button 24 of the first embodiment would be resisted, when the locking rod 42 is in the locked position, by reason of the slide bar 38 attempting to retract the latch bolt 28, and this being blocked by the locking rod 42. This same action would occur in the second embodiment shown in FIGS. 20–24. However, the restraining mechanism 160 adds a backup feature. For example, it may be that due to a certain looseness in the components of the assembly, or for some other reason, the locking bar 42 of the first embodiment may not function precisely as desired, relative to the precise positioning of the locking rod 42. If so, the restraining element 160 in the second embodiment would serve as a backup device to prevent this unwanted occurrence of someone at the front side of the latch assembly managing to retract the latch bolt 28*a* by pulling on the front, or outside, button 24*a* even though the latch assembly 10*a* is in the locked position.

A third embodiment of the present invention is shown in FIGS. 25 through 29. Components of this third embodiment which are similar to components of the first and second embodiments will be given like numerical designations, with a "*b*" suffix distinguishing those of this third embodiment.

In this third embodiment, the locking rod 42*b* is modified from the first two embodiments with respect to the location and dimension of the necked-down portion 82*b* formed by the cutouts 80*b* formed along the side edges of the locking rod 42*b*. There is provided a restraining mechanism 160*b* which is the same as the restraining mechanism 160 of the second embodiment. However, instead of this restraining mechanism 160*b* being a backup mechanism, this restraining mechanism 160*b* serves the primary function of preventing the unwanted retraction of the latch bolt 28*b* by a person grasping the front cylinder or button 24*b* by pliers or the like and pulling this cylinder or button 24*b* outwardly.

Thus, as in the first embodiment, there is a latch case 36*b* to receive therein the latch bolt 28*b*. The slide bar 38*b* is configured the same as the slide bar 38*a* of the second embodiment. There is a lock barrel 44*b* and a locating spring assembly 48*b*, and these are the same as in the previous two embodiments.

Figure 26:
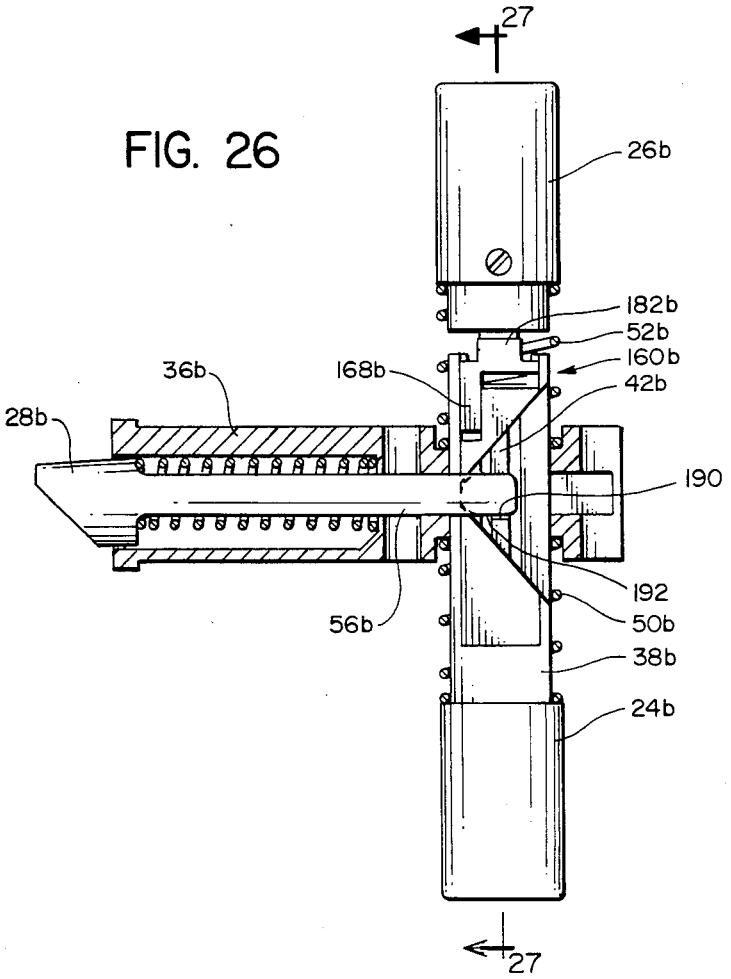
FIG. 26 is a sectional view similar to FIGS. 3 and 21, illustrating the third embodiment.
Figures 27, 28, 29:
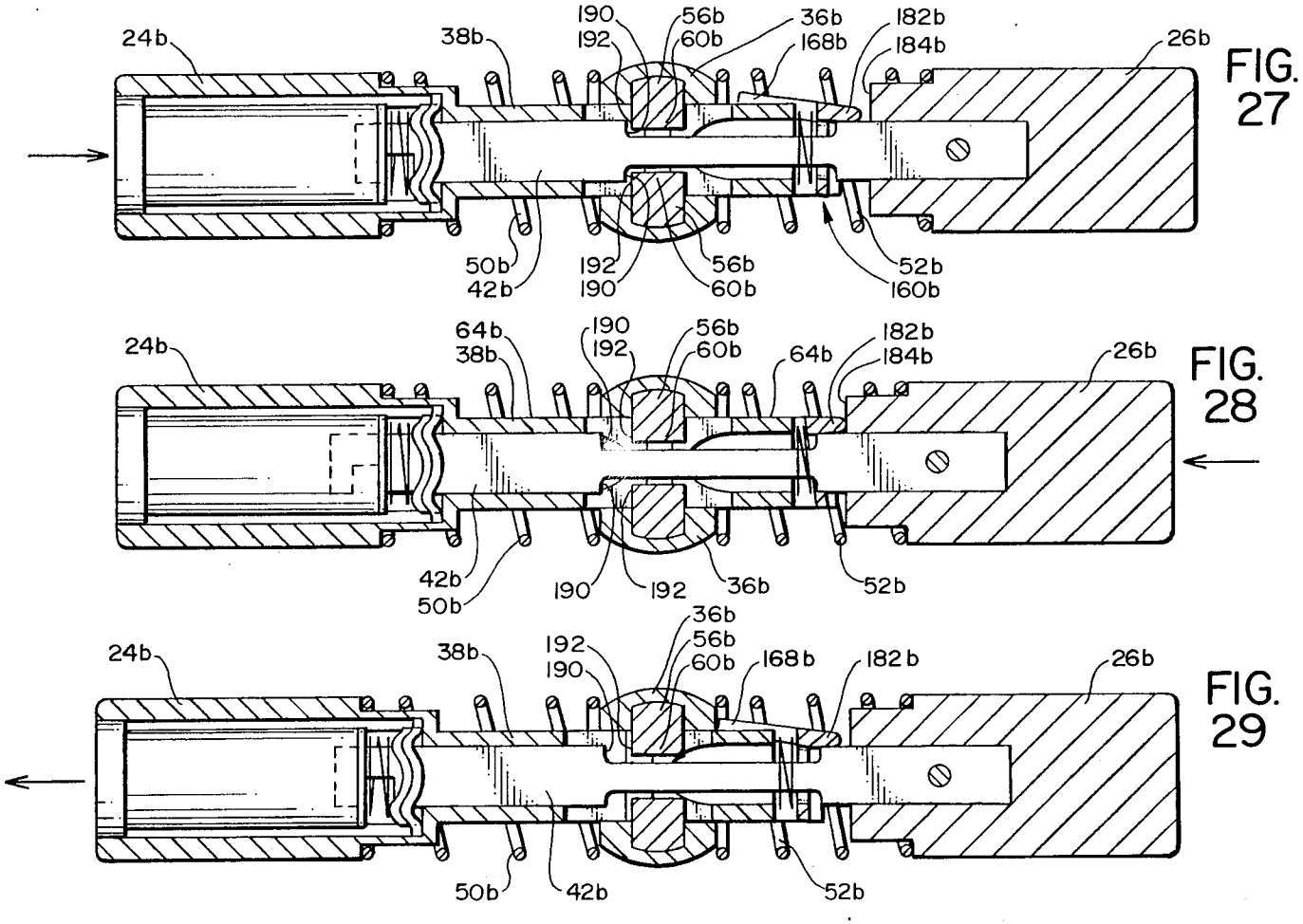
FIGS. 27, 28 and 29 are sectional views similar to FIGS. 22, 23, and 24 showing the third embodiment in its locking position and in three different operating conditions, with FIG. 27 being the intermediate position, FIG. 28 being the condition where the assembly is moved to its unlocking position by pushing from an inside location, and FIG. 29 illustrating how the assembly remains locked when there is a pulling force exerted on the exterior button.

With reference to FIGS. 26 and 27, it can be seen that the reduced width portion 82*b* (i.e. the "necked-down" portion) of the locking rod 42*b* is such that with the slide bar 38*b* in the intermediate position (as shown in FIGS. 26 and 27), the forward vertical edges or shoulder portions 190 at the front of the necked-down portion 80*b* are positioned a short distance forwardly of the forwardly facing lateral surfaces 192 at the inside ends of the legs 56*b* of the latch bolt 28*b*. Further, it will be noted that the protruding portion 60*b* at the rear ends of the legs 56*b* are not rounded out as in the first and second embodiments. Thus, with the locking rod 42*b* vertically oriented (i.e. in its locking position), the shoulders or edge portions 190 would not permit the forward part of the locking rod 42*b* to enter into the space between these protruding portions 60*b*.

To describe the operation of the present invention, reference is now made to FIGS. 27–29. In FIG. 27, the slide bar 38*b* is in the intermediate position, and the locking rod 42*b* is in its vertically oriented locking position. Let it be assumed that a person positioned forwardly of the door pushes against the forward button or cylinder 24*b* so as to move it inwardly. After the cylinder 24*b* travels a very short distance, the shoulders 190 of the locking rod 42*b* would come into contact with the forwardly facing lateral surfaces 192 of the protruding portion 62*b* at the inner ends of the latch bolt legs 56*b*. This would stop any further inward movement of the cylinder or button 24*b* and the slide bar 38*b* so that the latch 28*b* could not be retracted.

With reference to FIG. 28, let it now be assumed that a person positioned rearwardly of the door pushes inwardly against the rear actuating button or cylinder 26*b*. First, the forwardly facing surface 184*b* of the cylinder or button 26*b* would engage the finger 182*b* to move the restraining finger 168*b* downwardly so that it is flush with the upper surface 64*b* of the slide bar 38*b*. Thus, the restraining figure 168*b* would not lock further forward movement of the actuating button 26*b* and the slide bar 38*b*. As the button 26*b* and the slide bar 38*b* continue further forward movement, the latch bolt 28*b* is retracted in the manner described above.

With reference to FIG. 29, let us now assume that a person at a location forwardly of the door attempts to grasp the forward actuating button or cylinder 24*b* with a pair of pliers or the like and attempts to pull it forwardly. If this were to occur, the restraining finger 168 would immediately be moved forwardly (since the actuating button 24*b* is fixedly connected to the slide bar 38*b*) so that the restraining finger 168*b* would block further forward movement of the cylinder or button 24*b* and of the slide bar 38*b*.

Thus, it can be seen that in this third embodiment, there is still the "panic release" provision of the invention in that whether the locking rod 42*b* is in its locking or unlocked position, the latch bolt 28*b* can be retracted by an inward push against the rear button or cylinder 26*b*. On the other hand, with the locking rod 42*b* in its locking position, neither a rearward nor a forward force exerted on the button or cylinder 24*b* will cause the latch bolt 28 to retract.

Another difference in the operation of the third embodiment of FIGS. 25 through 29, in comparison with the first two embodiments, is that the latch bolt 28*b* is able to be pushed inwardly whether or not the locking rod 42*b* is in its locking position. The reason for this is that the necked-down portion 82*b* of the locking rod 42*b* is, with the slide bar 38*b* in the center position, in alignment with the protruding portion 60*b* of the legs 56*b* of the latch bolt 28*b*. Thus, if the door on which the assembly 10*b* is mounted has the locking rod 42*b* in the locking position, and the door is open, if the door is slammed shut, then the slanted contact face 54*b* of the latch bolt 28*b* will cause the latch bolt 28*b* to move inwardly and permit the door to close, after which the latch bolt 28*b* will spring outwardly into the opening in the striker plate and thus maintain the door in its closed position.

On the other hand, in the first two embodiments, with the locking rod 42 (of the first embodiment) or 42*a* (of the second embodiment) is in its locking position, the latch bolt 28, or 28*a*, cannot be pressed inwardly by exerting an inward force against the outer end of the latch bolt 28 or 28*a* when the slide bar 38 or 38*a* is in its intermediate position. Thus, if the door to which the assembly 10 or 10*a* is mounted is in the open position and the door is slammed shut, the latch bolt 28 or 28*a* will not retract and thus will not permit the door to be closed.

It is something of a matter of personal preference as to whether or not the person would like to door to be able to be slammed shut or not when the locking rod 42, 42*a*, or 42*b* is in the locking position. One advantage of the first two embodiments is that a person leaving the room or the building is not able to slam the door shut while the latch assembly is in the locked position. This would avoid the person inadvertently slamming the door shut (and locked) while the person has forgotten his or her key. On the other hand, the third embodiment of FIGS. 25 through 29 provides the convenience of being able to slam the door shut without having to worry about whether the door is locked or unlocked.

As indicated above, it is a matter of personal preference as to which system the person might want. However, one of the desirable features of the present invention is that the embodiments can be arranged to permit this particular operating characteristic to be one way or the other.

It is to be recognized that various changes could be made to the present invention without departing from the basic teachings thereof.

What is claimed is:

1. A latching assembly adapted to be mounted to a door, said assembly having a front end, a rear end, a lateral end, a longitudinal front to rear axis and a transverse axis which is perpendicular to the longitudinal axis, said assembly comprising:

a. a housing structure;

b. an actuating subassembly comprising (1) a latch bolt means mounted in said housing structure and having an outer latching end and an inner end, said latch bolt means being movable along said transverse axis between an extended latching position and a retracted release position, (2) a slide bar means mounted in said housing structure for movement along said longitudinal axis from an intermediate position to either a forward position or a rear position, said slide bar means having an operative connection to said latch bolt means in a manner that with the slide bar means in said intermediate position, said latch bolt means is in said extended latching position, and movement of said slide bar means to either of said forward and rear positions causes said latch bolt means to move to said retracted release position;

c. a forward actuating member operatively connected to said slide bar means and positioned at a forward end of said assembly to be pushed rearwardly to move said slidebar means rearwardly to retract said latch bolt means;

d. a rear actuating member having an operative connection to said slide bar means and positioned at a rear end of said assembly to be pushed forwardly to move said slide bar means forwardly to retract said latch bolt means;

e. a locking means mounted in said assembly for movement between a locking position and an unlocking position, said locking means being characterized in that in said locking position said locking means prevents retraction of said latch bolt resulting from either a rearward push against said forward actuating member or from a forward pulling force exerted on said forward actuating member; and f. said rear actuating member having an operative connection to said locking means in a manner that a forward push on said rear actuating member causes said locking means to become at least partially released so as to permit forward movement of said slide bar means to retract said latch bolt means, whereby with said locking means in said locking position, said latch bolt means is not able to be retracted by either a rearward push against, or a forward pull on, said forward actuating member, but said latch bolt is retracted by a forward push on said rear actuating member, regardless of whether said locking means is in the locking or unlocking position.

2. The assembly as recited in claim 1, wherein said locking means comprises locking rod means rotatably mounted in said assembly for movement between said locking and unlocking positions.

3. The assembly as recited in claim 2, wherein said locking rod means extends along said longitudinal axis and is operatively connected to said forward and rear actuating members in a manner that rotation of at least a portion of either of said forward and rear actuating members moves said locking rod means between said locking and unlocking positions.

4. The assembly as recited in claim 3, wherein said locking rod means has a blocking portion which, with the locking rod means in said locking position, prevents movement of said actuating subassembly to retract said latch bolt means, said locking rod means being responsive to forward motion of at least a portion of said rear actuating member to move said locking rod means to where the blocking portion no longer prevents movement of said actuating subassembly so as to retract said latch bolt means.

5. The assembly as recited in claim 4, wherein, with the locking rod means in the locking position, and with the slide bar means in said intermediate position, the blocking portion of the locking rod means is in a blocking position located adjacent to the inner end of said latch bolt means so as to prevent retraction of said latch bolt means.

6. The assembly as recited in claim 5, wherein said rear actuating member and said locking rod means are arranged so that forward movement of said rear actuating member causes movement of said locking rod means to move said blocking portion of the locking rod means out of its blocking position, in a manner that further forward movement of said rear actuating member causes said slide bar means to retract said latch bolt means.

7. The assembly as recited in claim 6, wherein said locking rod means has a reduced width portion which, when adjacent to said latch bolt means, permits movement of the latch bolt means to said retracted position, and an expanded width portion which comprises said blocking portion, said assembly being characterized in that said blocking portion is located, with said slide bar means in said intermediate position in alignment with said latch bolt means along said transverse axis, and movement of at least a portion of aid rear actuatingg means forwardly moves the blocking portion out of lateral alignment with the latch bolt means and places the reduced width portion of the locking bar means in alignment with the latch bolt means.

8. The assembly as recited in claim 7, wherein said locking bar means has a connection to said forward actuating member which permits at least limited forward to rear movement of said locking rod means relative to said forward actuating means.

9. The assembly as recited in claim 3, wherein said locking rod means is operatively connected to said front actuating member, and said locking rod means has a stop surface adapted to engage a matching stop surface in said assembly when said locking rod means is in its locking position and said forward actuating means is pushed rearwardly.

10. The assembly as recited in claim 2, wherein, said locking rod means is operatively connected to said front actuating member, and said locking rod means has a stop surface to engage a matching stop surface in said assembly when said locking rod means is in its locking position and said forward actuating means is pushed rearwardly.

11. The assembly as recited in claim 10, wherein said locking means further comprises stop finger means operatively connected to said slide bar means and movable between a restraining and an unrestraining position, said stop finger means being characterized in that with the stop finger means in the restraining position, forward movement of said slide bar means is prevented.

12. The assembly as recited in claim 11, wherein said stop finger means has an operative connection with said rear actuating member in a manner that an initial forward movement of said rear actuating member moves said stop finger to its unrestraining position.

13. The assembly as recited in claim 12, wherein said stop finger means is mounted in a rear portion of said slide bar means in a manner that said stop finger means is normally positioned in its restraining position, said stop finger means being arranged to be engaged by said rear actuating member in a manner that initial movement of said rear actuating member moves said stop finger means to its unrestraining position in said slide bar means, and further forward movement of said rear actuating member causes forward movement of said slide bar means.

14. The assembly as recited in claim 13, wherein said stop finger means has associated spring means engaging the stop finger means to urge the stop finger means to its restraining position, said stop finger means being mounted for limited rotational movement in a manner that engagement with said rear actuating member causes limited rotation of said stop finger means against urging of said spring means to move the stop finger means to said unrestraining position.

15. The assembly as recited in claim 14, wherein said stop finger means comprises a mounting plate portion mounted in the rear end of the slide bar means, and said stop finger means in the restraining position extends outwardly from a center axis of said slide bar means, said spring means acting against said mounting plate means to urge said stop finger means to its restraining position, said rear actuating member being arranged to engage said mounting plate means to cause rotation thereof to move the stop finger means to said unrestraining position.

16. The assembly as recited in claim 1, wherein said locking means comprises a rotatably mounted locking rod means rotatable between a first locking position and a second locking position, said locking rod means being provided with locking positioning means arranged to yieldingly hold said locking rod means in either of said locking or unlocking positions, said locking rod positioning means comprising a first positioning member having raised and recessed portions and being mounted so as to be rotatable with said locking rod means, said locking rod means positioning means comprising a second positioning member having raised and recessed portions matching with the raised and recessed portions of said first positioning member and positioned so as to be nonrotatable with respect to said locking rod means, said first and second positioning members being interengaged with one another in a manner that with said locking rod means in either of its locking and unlocking positions, the raised and recessed portions of the first and second positioning members are in matching engagement, while with the locking rod means in an intermediate position between the locking and unlocking positions, the raised and recessed portions of the first and second positioning members are out of matching engagement so as to urge the locking rod means to remain in either of said locking and unlocking positions.

17. The assembly as recited in claim 16, wherein said locking rod positioning means further comprises a positioning spring member yieldingly urging said first and second positioning members into engagement with one another.

18. The assembly as recited in claim 17, wherein said first and second positioning members are plate-like members which have said raised and recessed portions arranged in a circumferential pattern around a center location, with said raised and recessed portions extending radially outwardly from said center location.

19. The assembly as recited in claim 18, wherein said spring positioning means further comprises a positioning plate member mounted to said locking rod means, said positioning plate member and said locking rod means have interengaging notched portions so as to locate said positioning plate member relative to said locking rod means, and the positioning spring means acts from said positioning plate member to said positioning members to urge the positioning members into engagement with one another.

20. A latching assembly adapted to be mounted to a door, said assembly having a front end, a rear end, a lateral end, a longitudinal front to rear axis and a transverse axis which is perpendicular to the longitudinal axis, said assembly comprising:

a. a housing structure;

b. an actuating subassembly comprising (1) a latch bolt means mounted in said housing structure and having an outer latching end and an inner end, said latch bolt means being movable along said transverse axis between an extended latching position and a retracted release position, (2) a slide bar means mounted in said housing structure for movement along said longitudinal axis from an intermediate position to either a forward position or a rear position, said slide bar means having an operative connection to said latch bolt means in a manner that with the slide bar means in said intermediate position, said latch bolt means is in said extended latching position, and movement of said slide bar means to either of said forward and rear positions causes said latch bolt means to move to said retracted release position;

c. a forward actuating member operatively connected to said slide bar means and positioned at a forward end of said assembly to be pushed rearwardly to move said slide bar means rearwardly to retract said latch bolt means;

d. a rear actuating member having an operative connection to said slide bar means and positioned at a rear end of said assembly to be pushed forwardly to move said slide bar means forwardly to retract said latch bolt means;

e. a locking means mounted in said assembly for movement between a locking position and an unlocking position, said locking means comprising a locking rod means rotatably mounted in said assembly for movement between said locking and unlocking positions, said locking rod means extending along said longitudinal axis and being operatively connected to said forward and rear actuating members in a manner that rotation of at least a portion of either of said forward and rear actuating members moves said locking rod means between said locking and unlocking positions, said locking rod means having a blocking portion which, with the locking rod means in said locking position, prevents movement of said actuating subassembly to retract said latch bolt means; and f. said rear actuating member having an operative connection to said locking rod means in a manner that a forward push on said rear actuating member causes said locking rod means to move forwardly to move said locking rod means to where the blocking portion no longer prevents movement of said actuating subassembly so as to retract said latch bolt means, whereby with said locking means in said locking position, said latch bolt means is not able to be retracted by either a rearward push against, or a forward pull on, said forward actuating member, but said latch bolt is retracted by a forward push on said rear actuating member, regardless of whether said locking means is in the locking or unlocking position.

21. The assembly as recited in claim 20, wherein, with the locking rod means in the locking position, and with the slide bar means in said intermediate position, the blocking portion of the locking rod means is in a blocking position located adjacent to the inner end of said latch bolt means so as to prevent retraction of said latch bolt means.

22. The assembly as recited in claim 21, wherein said rear actuating member and said locking rod means are arranged so that forward movement of said rear actuating member causes movement of said locking rod means to move said blocking position of the locking rod means out of its blocking position, in a manner that further forward movement of said rear actuating member causes said slide bar means to retract said latch bolt means.

23. The assembly as recited in claim 22, wherein said locking rod means has a reduced width portion which, when adjacent to said latch bolt means, permits movement of the latch bolt means to said retracted position, and an expanded width portion which comprises said blocking portion, said assembly being characterized in that said blocking portion is located, with said slide bar means in said intermediate position in alignment with said latch bolt means along said transverse axis, and movement of at least a portion of said rear actuating means forwardly moves the blocking portion out of lateral alignment with the latch bolt means and places the reduced width portion of the locking bar means in alignment with the latch bolt means.

24. The assembly as recited in claim 23, wherein said locking bar means has a connection to said forward actuating member which permits at least limited forward to rear movement of said locking rod means relative to said forward actuating means.

25. A latching assembly adapted to be mounted to a door, said assembly having a front end, a rear end, a lateral end, a longitudinal front to rear axis and a transverse axis which is perpendicular to the longitudinal axis, said assembly comprising:

a. a housing structure;

b. an actuating subassembly comprising (1) a latch bolt means mounted in said housing structure and having an outer latching end and an inner end, said latch bolt means being movable along said transverse axis between an extended latching position and a retracted release position, (2) a slide bar means mounted in said housing structure for movement along said longitudinal axis from an intermediate position to either a forward position or a rear position, said slide bar means having an operative connection to said latch bolt means in a manner that with the slide bar means in said intermediate position, said latch bolt means is in said extended latching position, and movement of said latch bar means to either of said forward and rear positions causes said latch bolt means to move to said retracted release position;

c. a forward actuating member operatively connected to said slide bar means and positioned at a forward end of said assembly to be pushed rearwardly to move said slide bar means rearwardly to retract said latch bolt means;

d. a rear actuating member having an operative connection to said slide bar means and positioned at a rear end of said assembly to be pushed forwardly to move said slide bar means forwardly to retract said latch bolt means;

e. a restraining means mounted in said assembly for movement between a restraining position and an unrestraining position, said restraining means being characterized in that said restraining means prevents retraction of said latch bolt resulting from a forward pulling force exterted on said forward actuating member, said restraining means comprising stop finger means operatively connected to said slide bar means and movable between a restraining and unrestraining position, said stop finger means being characterized in that with the stop finger means in the restraining position, forward movement of said slide bar means is prevented; and f. said rear actuating member having an operative connection to said restraining means in a manner that a forward push on said rear actuating member causes said restraining means to move to said unrestraining position, whereby with said restraining means in said restraining position, said latch bolt means is not able to be retracted by a forward pull on said forward actuating member, but said latch bolt is retracted by a forward push on said rear actuating member.

26. The assembly as recited in claim 25, wherein said stop finger means has an operative connection with said rear actuating member in a manner that an initial forward movement of said rear actuating member moves said stop finger to its unrestraining position.

27. The assembly as recited in claim 26, wherein said stop finger means is mounted in a rear portion of said slide bar means in a manner that said stop finger means is normally positioned in its restraining position, said stop finger means being arranged to be engaged by said rear actuating member in a manner that initial movement of said rear actuating member moves said stop finger means to its unrestraining position in said slide bar means, and further forward movement of said rear actuating member causes forward movement of said slide bar means.

28. The assembly as recited in claim 27, wherein said stop finger means has associated spring means engaging the stop finger means to urge the stop finger means to its restraining position, said stop finger means being mounted for limited rotational movement in a manner that engagement with said rear actuating member causes limited rotation of said stop finger means against urging of said spring means to move the stop finger means to said unrestraining position.

29. The assembly as recited in claim 28, wherein said stop finger means comprises a mounting plate portion mounted in the rear end of the slide bar means, and said stop finger means in the restraining position extends outwardly from a center axis of said slide bar means, said spring means acting against said mounting plate means to urge said stop finger means to its restraining position, said rear actuating means being arranged to engage said mounting plate means to cause rotation thereof to move the stop finger means to said unrestraining position.

30. A latching assembly adapted to be mounted to a door, said assembly comprising:

a. a housing structure;

b. a latch bolt mounted in said housing structure so as to be movable between an extended position and a retracted position;

c. a locking means mounted in said assembly for movement between a locking position and an unlocking position, said locking means comprising a locking rod means rotatably mounted in said assembly for movement between said locking and unlocking positions; and d. said locking rod means being provided with a locking rod positioning means arranged to yieldingly hold said locking rod means in either of said locking or unlocking positions, said locking rod positioning means comprising a first positioning member having raised and recessed portions and being mounted so as to be rotatable with said locking rod means, said locking rod means positioning means comprising a second positioning member having raised and recessed portions matching with the raised and recessed portions of said first positioning member and positioned so as to be nonrotatable with respect to said locking rod means, said first and second positioning members being interengaged with one another in a manner that with said locking rod means in either of its locking or unlocking positions, the raised and recessed portions of the first and second positioning members are in matching engagement, while with the locking rod means in an intermediate position between the locking and unlocking positions, the raised and recessed portions of the first and second positioning members are out of matching engagement so as to urge the locking rod means to remain in either of said locking and unlocking positions.

31. The assembly as recited in claim 30, wherein said locking rod positioning means further comprises a positioning spring member yieldingly urging said first and second positioning members into engagement with one another.

32. The assembly as recited in claim 31, wherein said first and second positioning members are plate-like members which have said raised and recessed portions arranged in a circumferential pattern around a center location, with said raised and recessed portions extending radially outwardly from said center location.

33. The assembly as recited in claim 32, wherein said spring positioning means further comprises a positioning plate member mounted to said locking rod means, said positioning plate member and said locking rod means have interengaging notched portions so as to locate said positioning plate member relative to said locking rod means, and the positioning spring means acts from said positioning plate member to said positioning members to urge the positioning members into engagement with one another.

34. A method of operating a latching assembly from an inside location under circumstances when the assembly is in a locked condition, said method comprising:

a. providing said assembly where the assembly has a front end, a rear end, a lateral end, a longitudinal front to rear axis and a transverse axis which is perpendicular to the longitudinal axis, and where said assembly comprises:

(1) a housing structure, (2) an actuating subassembly comprising:

(i) a latch bolt means mounted in said housing structure and having an outer latching end and an inner end, said latch bolt means being movable along said transverse axis between an extended latching position and a retracted release position, (ii) a slide bar means mounted in said housing structure for movement along said longitudinal axis from an intermediate position to either a forward position or a rear position, said slide bar means having an operative connection to said latch bolt means in a manner that with the slide bar means in said intermediate position, said latch bolt means is in said extended latching position, and movement of said latch bar means to either of said forward and rear positions causes said latch bolt means to move to said retracted release position;

(3) a forward actuating member at an outside location operatively connected to said slide bar means and positioned at a forward end of said assembly to be pushed rearwardly to move said slide bar means rearwardly to retract said latch bolt means, (4) a rear actuating member at an inside location having an operative connection to said slide bar means and positioned at a rear end of said assembly to be pushed forwardly to move said slide bar means forwardly to retract said latch bolt means, (5) a locking means mounted in said assembly for movement between a locking position and an unlocking position, said locking means being characterized in that in said locking position said locking means prevents retraction of said latch bolt resulting from either a rearward push against said forward actuating member or from a forward pulling force exerted on said forward actuating member;

b. providing said rear actuating member with an operative connection to said locking means in a manner that a forward push on said rear actuating member causes said locking means to become at least partially released so as to permit forward movement of said slide bar means to retract said latch bolt; and c. said method further comprising placing said locking means in the locking position and then pushing the rear actuating member forwardly to cause a partial release of the locking means and to retract said latch bolt.

35. The method as recited in claim 34, wherein said locking means comprises locking rod means rotatably mounted in said assembly for movement between said locking and unlocking positions, and the locking rod means extends along said longitudinal axis and is operatively connected to said forward and rear actuating members, said method comprising rotating at least a portion of said actuating member to move said locking rod means to said locking position.

36. The method as recited in claim 35, wherein said locking rod means has a blocking portion which, with the locking rod means in said locking position, prevents movement of said actuating subassembly to retract said latch bolt means, said locking rod means being responsive to forward motion of at least a portion of said rear actuating member to move said locking rod means to where the blocking portion no longer prevents movement of said actuating subassembly so as to retract said latch bolt means.

37. The method as recited in claim 36, wherein, with the locking rod means in the locking position, and with the slide bar means in said intermediate position, the blocking portion of the locking rod means is in a blocking position located adjacent to the inner end of said latch bolt means so as to prevent retraction of said latch bolt means, said method further comprising moving said rear actuating member forwardly to cause forward movement of said rear actuating member causes movement of said locking rod means to move said blocking portion of the locking rod means out of its blocking position, and moving said rear actuating member further forwardly to cause said slide bar means to retract said latch bolt means.

38. The method as recited in claim 37, wherein said locking rod means has a reduced width portion which, when adjacent to said latch bolt means, permits movement of the latch bolt means to said retracted position, and an expanded width portion which comprises said blocking portion, said assembly being characterized in that said blocking portion is located, with said slide bar means in said intermediate position in alignment with said latch bolt means along said transverse axis, and movement of at least a portion of said rear actuating means forwardly moves the blocking portion out of lateral alignment with the latch bolt means and places the reduced width portion of the locking bar means in alignment with the latch bolt means.

40. The method as recited in claim 34, wherein said locking means further comprises stop finger means operatively connected to said slide bar means and movable between a restraining and an unrestraining position, said stop finger means being characterized in that with the stop finger means in the restraining position, forward movement of said slide bar means is prevented, said method further comprising moving said rear actuating member initially in a forward direction to move said stop finger means to its unrestraining position.

41. The method as recited in claim 40, wherein said stop finger means is mounted in a rear portion of said slide bar means in a manner that said stop finger means is normally positioned in its restraining position, said stop finger means being arranged to be engaged by said rear actuating member in a manner that initial movement of said rear actuating member moves said stop finger means to its unrestraining position in said slide bar means, and further forward movement of said rear actuating member causes forward movement of said slide bar means.

42. The assembly as recited in claim 41, wherein said stop finger means has associated spring means engaging the stop finger means to urge the stop finger means to its restraining position, said stop finger means being mounted for limited rotational movement in a manner that engagement with said rear actuating member causes limited rotation of said stop finger means against urging of said spring means to move the stop finger means to said unrestraining position.

43. The assembly as recited in claim 42, wherein said stop finger means comprises a mounting plate portion mounted in the rear end of the slide bar means, and said stop finger means in the restraining position extends outwardly from a center axis of said slide bar means, said spring means acting against said mounting plate means to urge said stop finger means to its restraining position, said rear actuating means being arranged to engage said mounting plate means to cause rotation thereof to move the stop finger means to said unrestraining position.

* * * * *